US012252961B2

(12) United States Patent
Zhong et al.

(10) Patent No.: US 12,252,961 B2
(45) Date of Patent: Mar. 18, 2025

(54) EXPANDABLE LINER HANGER ASSEMBLY HAVING ONE OR MORE HARDENED SECTIONS

(71) Applicant: Halliburton Energy Services, Inc., Houston, TX (US)

(72) Inventors: Xiaoguang Allan Zhong, Singapore (SG); Abdolreza Gharesi, Singapore (SG); Zhihua Fan, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/750,662

(22) Filed: May 23, 2022

(65) Prior Publication Data

US 2023/0374890 A1 Nov. 23, 2023

(51) Int. Cl.
*E21B 43/10* (2006.01)

(52) U.S. Cl.
CPC ..... *E21B 43/103* (2013.01); *E21B 43/10* (2013.01); *E21B 43/105* (2013.01)

(58) Field of Classification Search
CPC ..... E21B 43/103; E21B 43/105; E21B 33/10; E21B 23/01; E21B 23/06; E21B 33/04; E21B 43/10
See application file for complete search history.

(56) References Cited

U.S. PATENT DOCUMENTS 2,152,628 A 4/1939 Gauthey
4,663,513 A 5/1987 Webber
4,832,125 A 5/1989 Taylor
4,919,460 A 4/1990 Milberger et al.
5,303,518 A 4/1994 Strickland
(Continued)

FOREIGN PATENT DOCUMENTS

EP 0289108 A2 2/1988
EP 2789791 A1 10/2014
(Continued)

OTHER PUBLICATIONS

Dutta, B., et al., "Additive Manufacturing by Direct Metal Deposition," Advanced Materials & Processes, May 2011, 4 pages.
(Continued)

*Primary Examiner* — Yong-Suk (Philip) Ro
(74) *Attorney, Agent, or Firm* — Scott Richardson; Parker Justiss, P.C.

(57) ABSTRACT

Provided is an expandable liner hanger assembly and a well system including the same. The expandable liner hanger assembly, in one aspect, includes a radially expandable tubular defining an interior passageway and an exterior surface. The expandable liner hanger assembly, in accordance with this aspect, further includes one or more continuous anchoring ridges extending radially outward from the radially expandable tubular, at least one of the one or more continuous anchoring ridges having a plurality of localized hardened sections placed circumferentially there around, the radially expandable tubular configured to move from an initial state wherein the one or more continuous anchoring ridges are not in contact with a wellbore tubular to an expanded state wherein the one or more continuous anchoring ridges are in gripping engagement with the wellbore tubular.

29 Claims, 23 Drawing Sheets

(56) References Cited

U.S. PATENT DOCUMENTS

| | | | | |
|---|---|---|---|---|
| 5,542,473 | A * | 8/1996 | Pringle | E21B 33/129 166/134 |
| 6,029,748 | A | 2/2000 | Forsyth et al. | |
| 6,098,717 | A | 8/2000 | Bailey et al. | |
| 6,378,606 | B1 | 4/2002 | Swor et al. | |
| 6,793,022 | B2 * | 9/2004 | Vick | E21B 33/129 166/387 |
| 7,360,592 | B2 | 4/2008 | Mcmahan | |
| 9,255,467 | B2 | 2/2016 | Thomson et al. | |
| 9,316,084 | B2 * | 4/2016 | Carter | E21B 34/142 |
| 9,580,981 | B2 | 2/2017 | Zhong et al. | |
| 9,695,651 | B2 | 7/2017 | Gorrara et al. | |
| 9,752,400 | B2 | 9/2017 | Hazelip et al. | |
| 10,337,298 | B2 | 7/2019 | Braddick | |
| 11,118,434 | B2 | 9/2021 | Hazelip et al. | |
| 11,156,065 | B2 | 10/2021 | Zhong et al. | |
| 11,225,000 | B2 | 1/2022 | Yu et al. | |
| 11,248,450 | B2 | 2/2022 | Hazelip | |
| 11,248,451 | B2 | 2/2022 | Sevadjian et al. | |
| 11,359,465 | B2 | 6/2022 | Williams | |
| 2001/0045289 | A1 | 11/2001 | Cook et al. | |
| 2001/0047866 | A1 | 12/2001 | Cook et al. | |
| 2002/0014339 | A1 | 2/2002 | Ross | |
| 2002/0139540 | A1 | 10/2002 | Lauritzen | |
| 2003/0042022 | A1 | 3/2003 | Lauritzen et al. | |
| 2003/0047322 | A1 | 3/2003 | Maguire et al. | |
| 2003/0094768 | A1 | 5/2003 | Kamiya et al. | |
| 2004/0149418 | A1 | 8/2004 | Bosma et al. | |
| 2004/0244994 | A1 | 12/2004 | Jackson et al. | |
| 2005/0011650 | A1 | 1/2005 | Harrall et al. | |
| 2005/0052019 | A1 | 3/2005 | Schroeder | |
| 2006/0237188 | A1 | 10/2006 | McMahan | |
| 2007/0257486 | A1 | 11/2007 | Filippov et al. | |
| 2012/0097384 | A1 * | 4/2012 | Valencia | E21B 33/1204 166/134 |
| 2012/0205091 | A1 * | 8/2012 | Turley | E21B 43/103 166/77.53 |
| 2012/0312542 | A1 | 12/2012 | Varghese et al. | |
| 2013/0248209 | A1 | 9/2013 | Watson | |
| 2014/0000911 | A1 | 1/2014 | Gorrara et al. | |
| 2014/0008082 | A1 | 1/2014 | O'Brien et al. | |
| 2014/0020911 | A1 | 1/2014 | Martinez | |
| 2014/0174763 | A1 | 6/2014 | Zhong et al. | |
| 2015/0068733 | A1 | 3/2015 | Dilber et al. | |
| 2015/0218903 | A1 * | 8/2015 | Sellers, Jr. | E21B 33/1291 166/380 |
| 2016/0053591 | A1 | 2/2016 | Hallundbaek et al. | |
| 2016/0090801 | A1 | 3/2016 | Hazelip et al. | |
| 2016/0326830 | A1 | 11/2016 | Hallundbaek et al. | |
| 2016/0356131 | A1 | 12/2016 | Humphrey et al. | |
| 2016/0369587 | A1 * | 12/2016 | Stæhr | E21B 33/1208 |
| 2017/0022775 | A1 | 1/2017 | Spitz et al. | |
| 2018/0045016 | A1 | 2/2018 | Radtke et al. | |
| 2018/0112486 | A1 | 4/2018 | Potts et al. | |
| 2018/0135369 | A1 | 5/2018 | Parekh et al. | |
| 2019/0218873 | A1 | 7/2019 | Davis et al. | |
| 2019/0316434 | A1 | 10/2019 | Davies et al. | |
| 2019/0330943 | A1 | 10/2019 | Givens et al. | |
| 2020/0149375 | A1 | 5/2020 | Bermudes et al. | |
| 2020/0173248 | A1 | 6/2020 | Yee et al. | |
| 2020/0332604 | A1 | 10/2020 | Whiddon et al. | |
| 2020/0370383 | A1 | 11/2020 | Hazelip | |
| 2021/0010353 | A1 | 1/2021 | Hazelip et al. | |
| 2021/0011576 | A1 | 1/2021 | Suto et al. | |
| 2021/0087902 | A1 | 3/2021 | Saeed | |
| 2021/0140263 | A1 | 5/2021 | Dockweiler et al. | |
| 2021/0310339 | A1 | 10/2021 | Williams | |
| 2022/0145712 | A1 | 5/2022 | Bermudez et al. | |
| 2023/0003097 | A1 | 1/2023 | Vasques | |
| 2023/0220743 | A1 | 7/2023 | Vasques | |
| 2023/0349270 | A1 | 11/2023 | Furlong et al. | |
| 2023/0374890 | A1 | 11/2023 | Zhong et al. | |
| 2023/0407730 | A1 | 12/2023 | Zhong et al. | |
| 2024/0117716 | A1 | 4/2024 | Zhong et al. | |
| 2024/0151123 | A1 | 5/2024 | Loh et al. | |
| 2024/0229614 | A1 | 7/2024 | Chevallier et al. | |

FOREIGN PATENT DOCUMENTS

| | | | |
|---|---|---|---|
| EP | 3667014 | A1 | 6/2020 |
| WO | 2011151139 | A1 | 12/2011 |
| WO | 2020185208 | | 9/2020 |
| WO | 2022177939 | | 8/2022 |

OTHER PUBLICATIONS

Labudovic, M., "A three dimensional model for direct laser metal powder deposition and rapid prototyping," Journal of Materials Science 38, 2003, pp. 35-49, Kluwer Academic Publishers.

TIW XPak System Hanger Packer, https://www.tiwoiltools.com/xpak-liner-hanger.html, 2018, 6 pages.

* cited by examiner

EXPANDABLE LINER HANGER ASSEMBLY HAVING ONE OR MORE HARDENED SECTIONS

BACKGROUND

During wellbore operations, it is typical to "hang" a liner onto a casing such that the liner supports an extended string of tubular below it. As used herein, "tubing string" refers to a series of connected pipe sections, casing sections, joints, screens, blanks, cross-over tools, downhole tools, and the like, inserted into a wellbore, whether used for drilling, work-over, production, injection, completion, or other processes. A tubing string may be run in and out of the casing, and similarly, tubing string can be run in an uncased wellbore or section of wellbore. Further, in many cases a tool may be run on a wireline or coiled tubing instead of a tubing string, as those of skill in the art will recognize.

Expandable liner hangers may generally be used to secure the liner within a previously set wellbore tubular (e.g., casing or liner string). Expandable liner hangers may be "set" by expanding the liner hanger radially outward into gripping and sealing contact with the wellbore tubular. For example, expandable liner hangers may be expanded by use of hydraulic pressure to drive an expanding cone, wedge, or "pig," through the liner hanger. Other methods may be used, such as mechanical swaging, explosive expansion, memory metal expansion, swellable material expansion, electromagnetic force-driven expansion, etc.

The expansion process may typically be performed by means of a setting tool used to convey the liner hanger into the wellbore. The setting tool may be interconnected between a work string (e.g., a tubular string made up of drill pipe or other segmented or continuous tubular elements) and the liner hanger. The setting tool may expand the liner hanger into anchoring and sealing engagement with the casing.

BRIEF DESCRIPTION

Reference is now made to the following descriptions taken in conjunction with the accompanying drawings, in which.

Figure 10A:
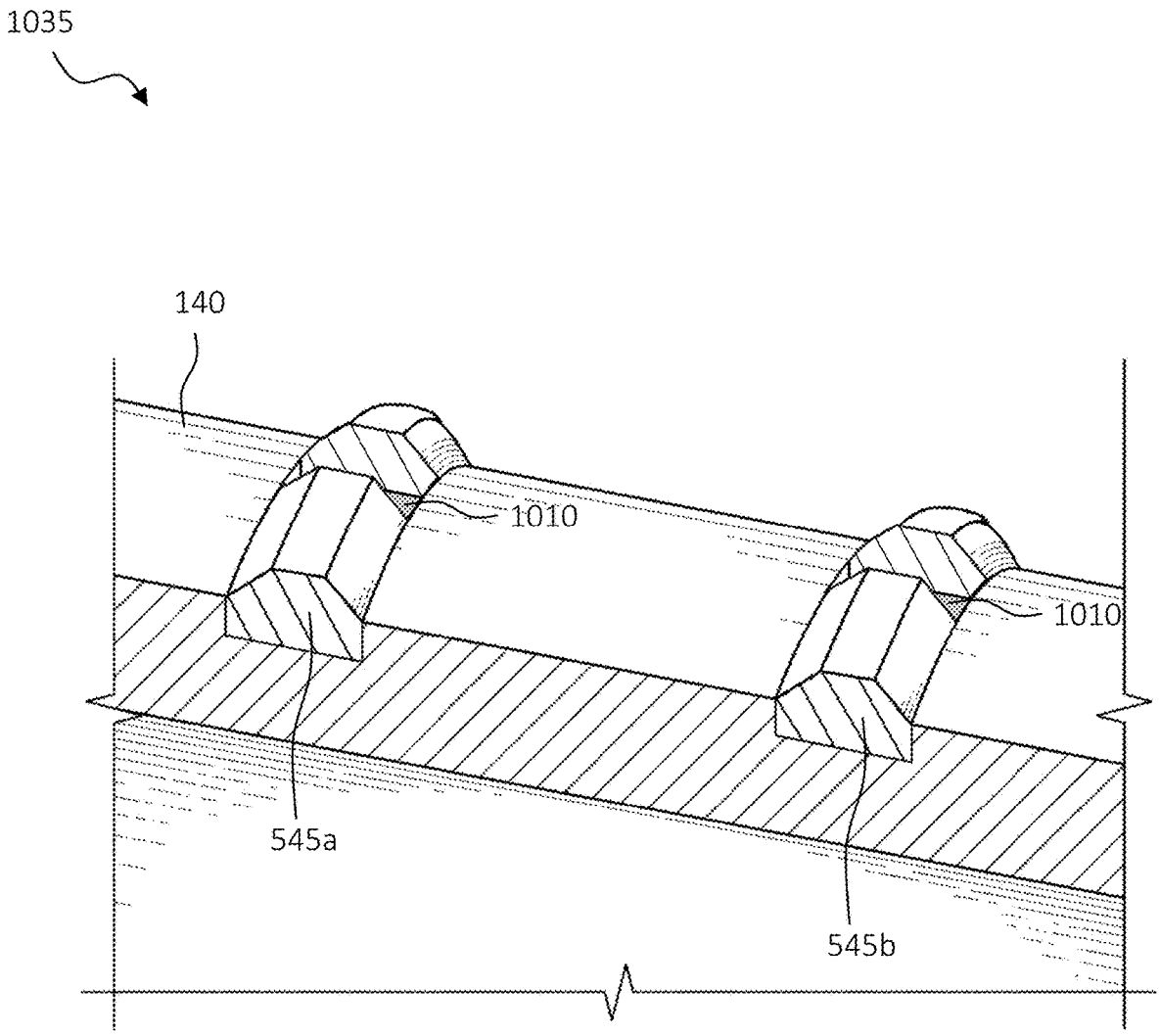
FIG. 10A illustrates a perspective view of an expandable liner hanger assembly, for example similar to the expandable liner hanger of FIGS. 5 and 6, but employing a C-ring attached to the discrete slip teeth to hold the plurality of discrete slip teeth within the shallow groove.
Figure 10B:
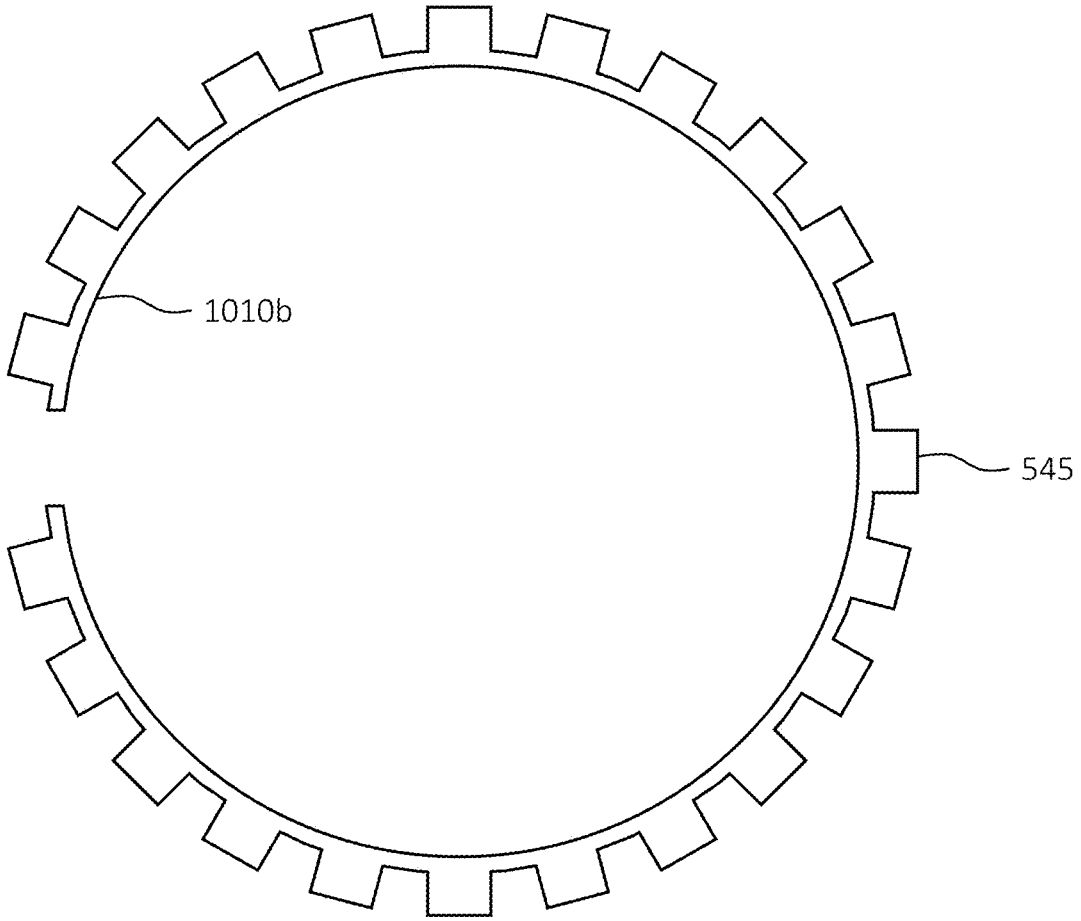
Figure 10C:
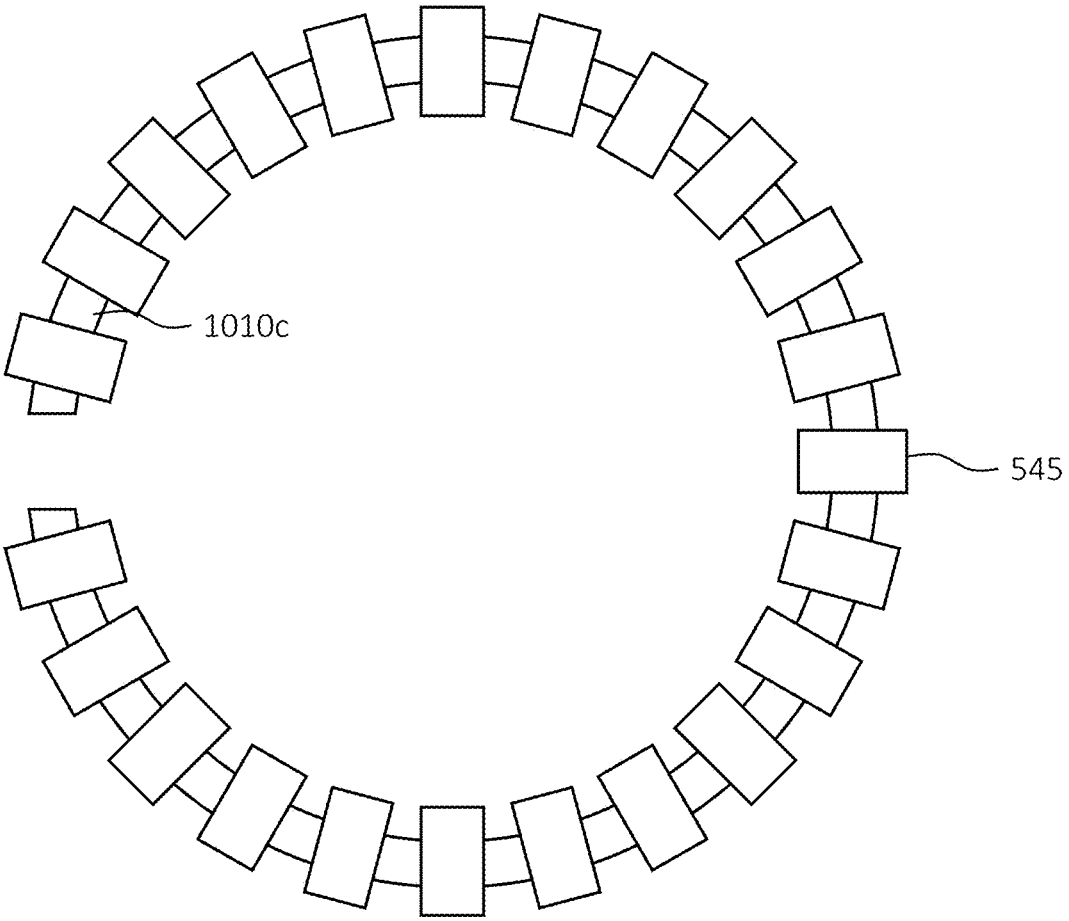
Figure 11A:
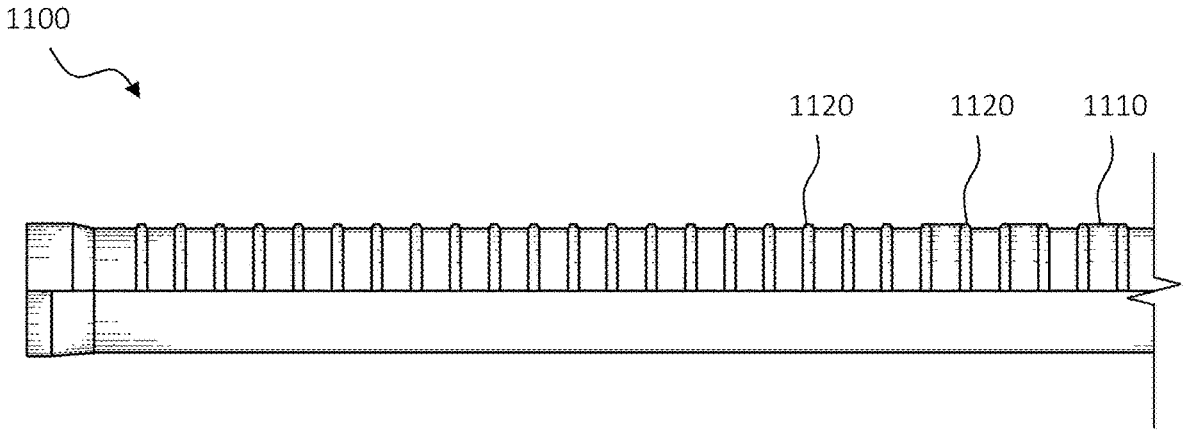
Figure 11B:
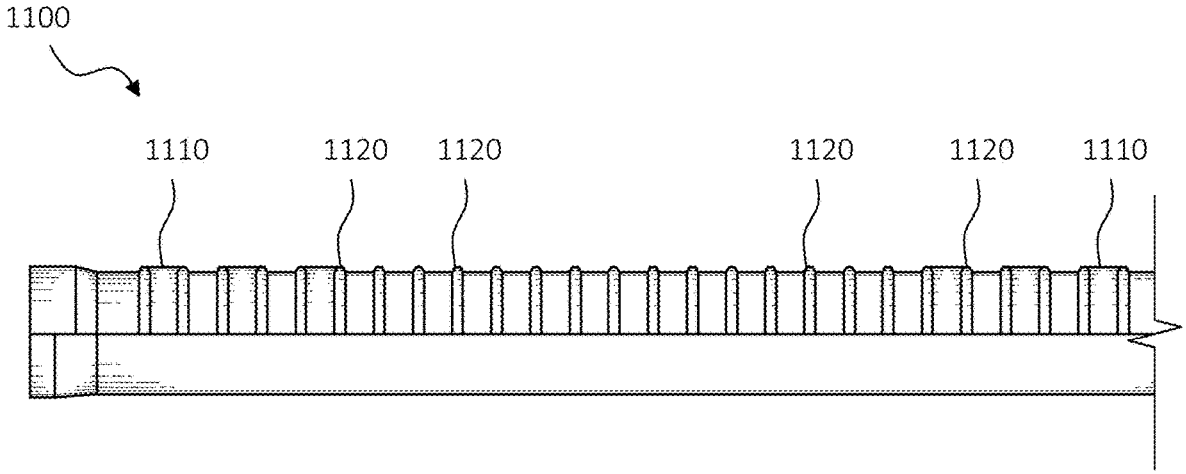
Figure 12A:
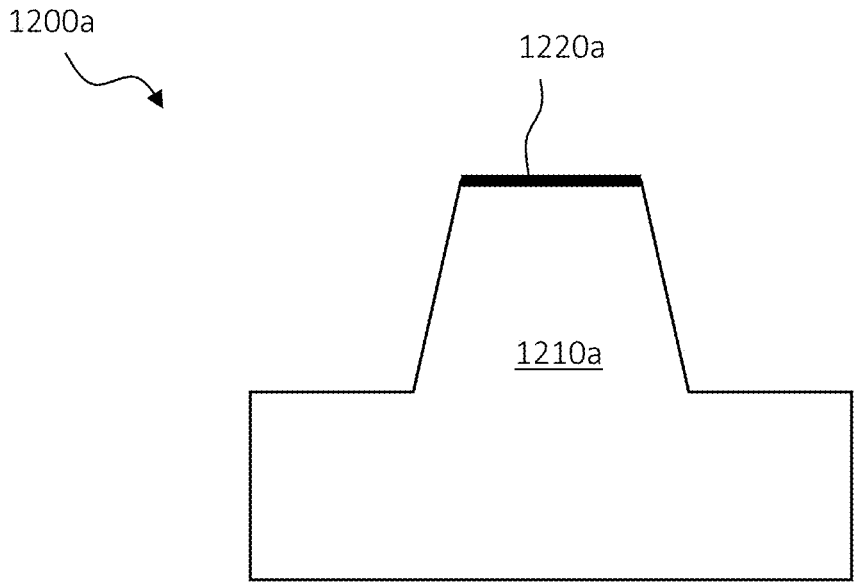
Figure 12B:
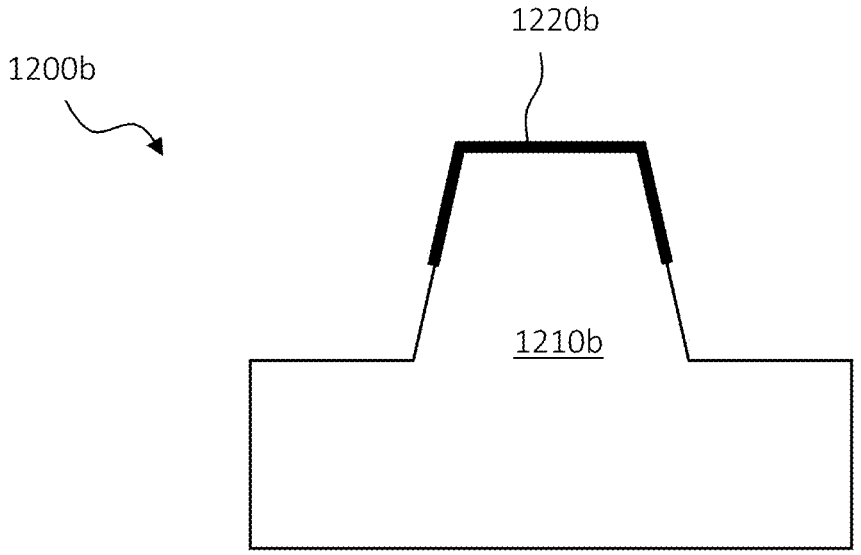
Figure 12C:
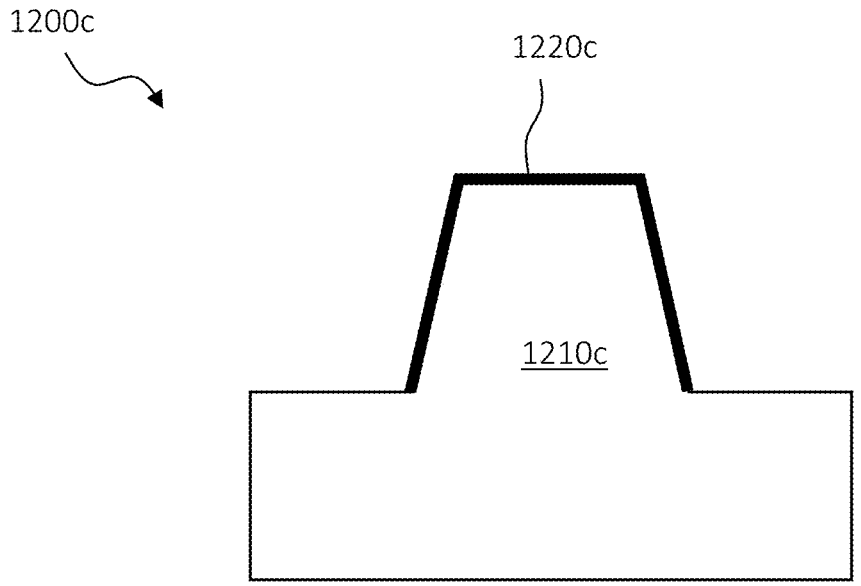
Figure 12D:
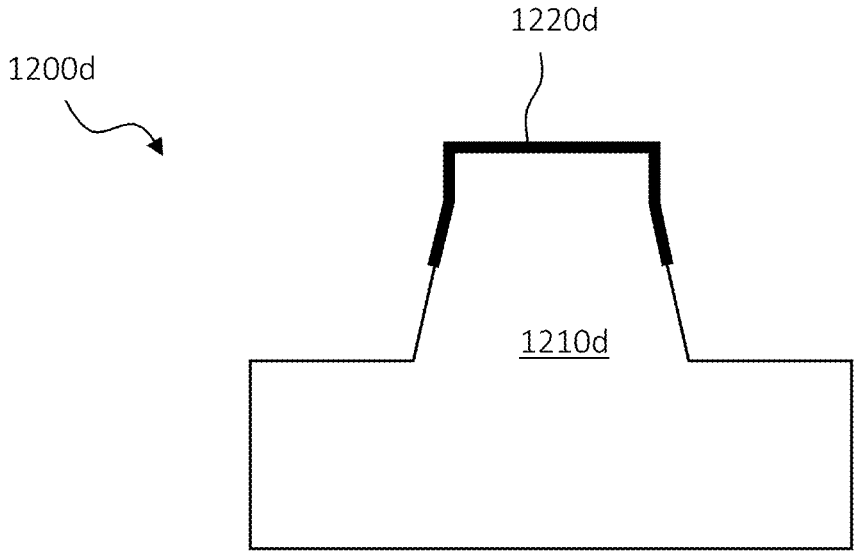
Figure 12E:
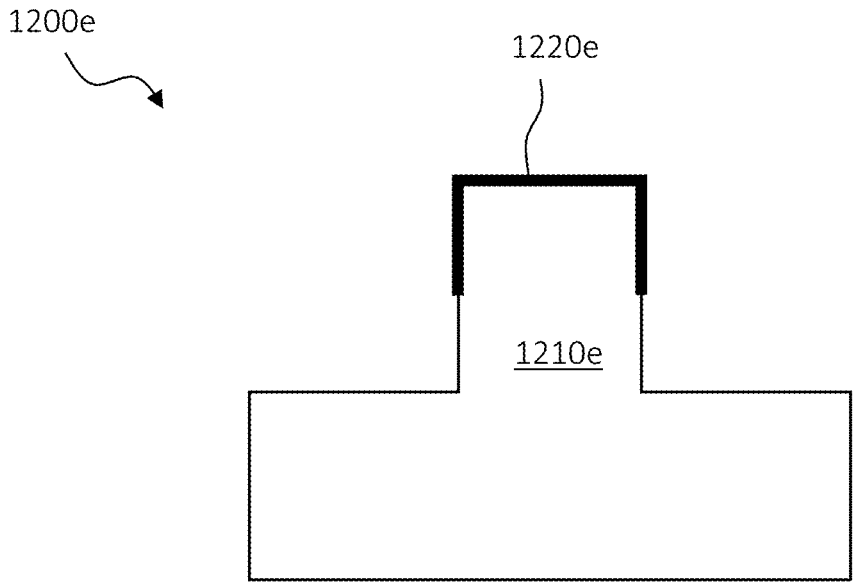
Figure 12F:
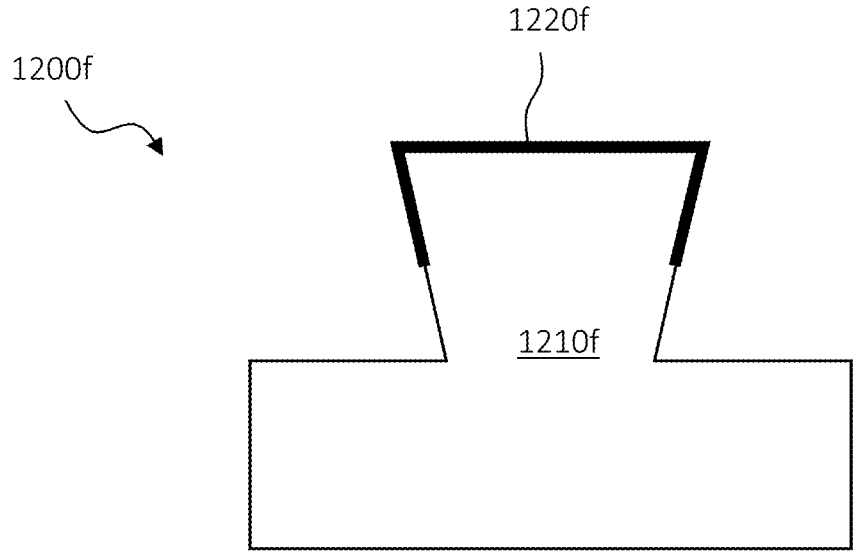
Figure 12G:
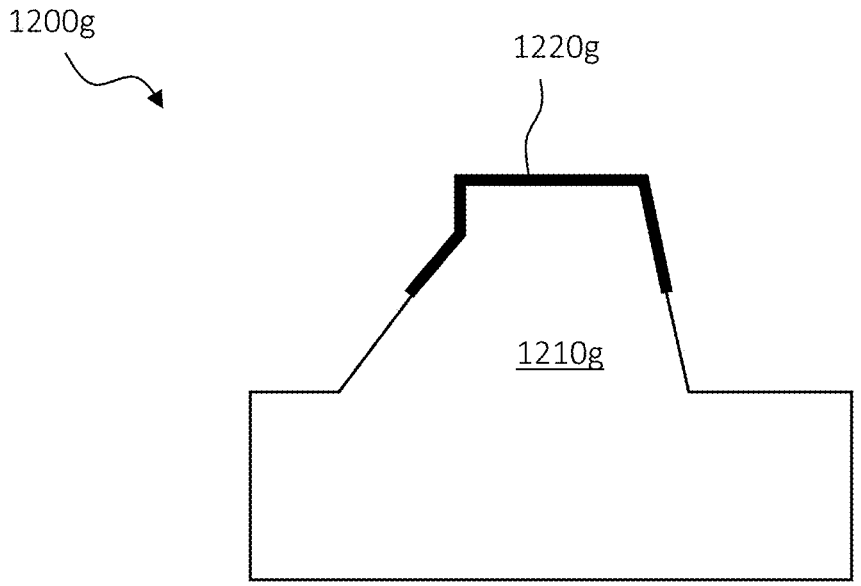
Figure 12H:
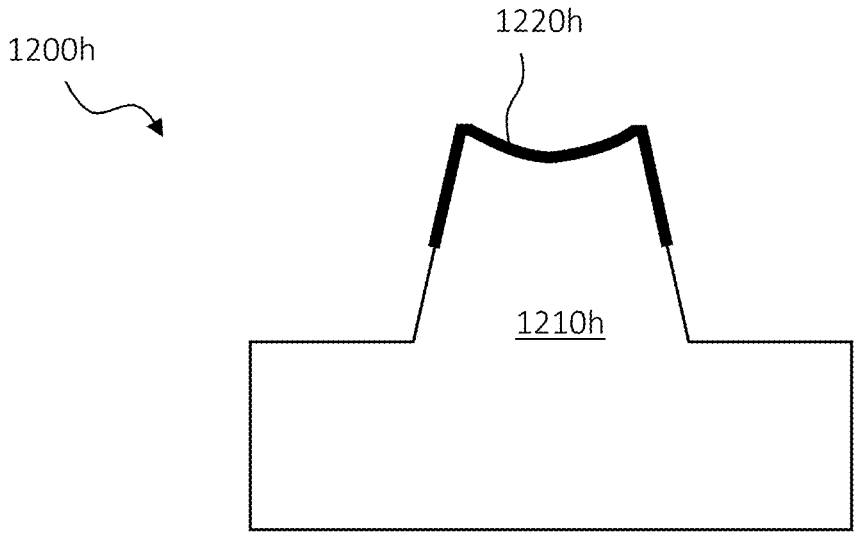
Figure 12I:
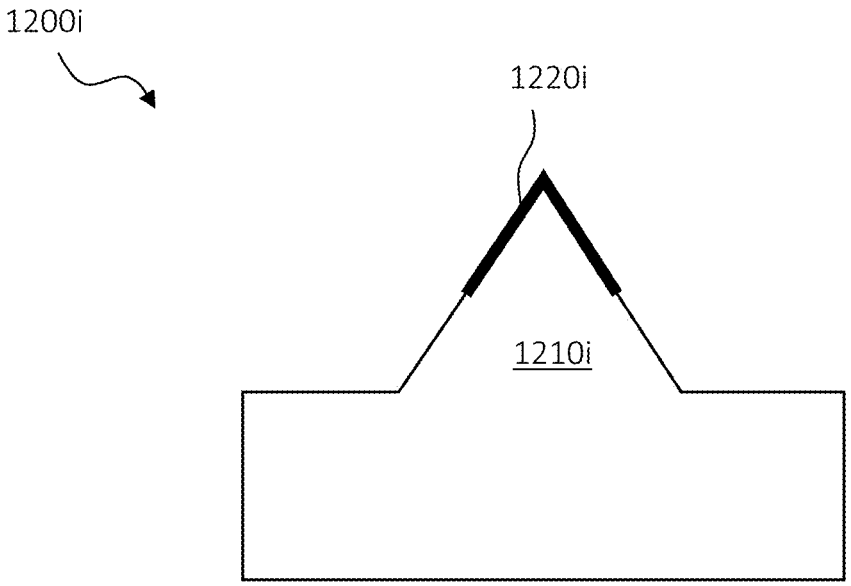
Figure 12J:
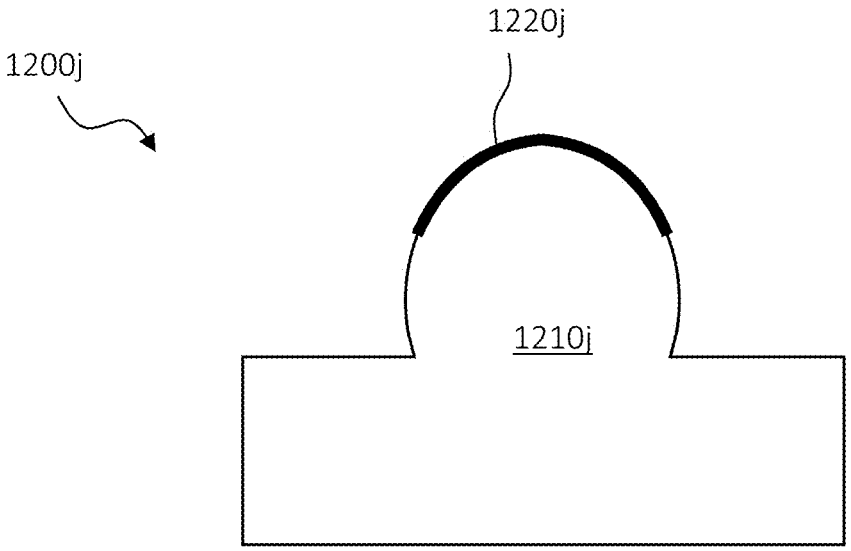
Figure 13:
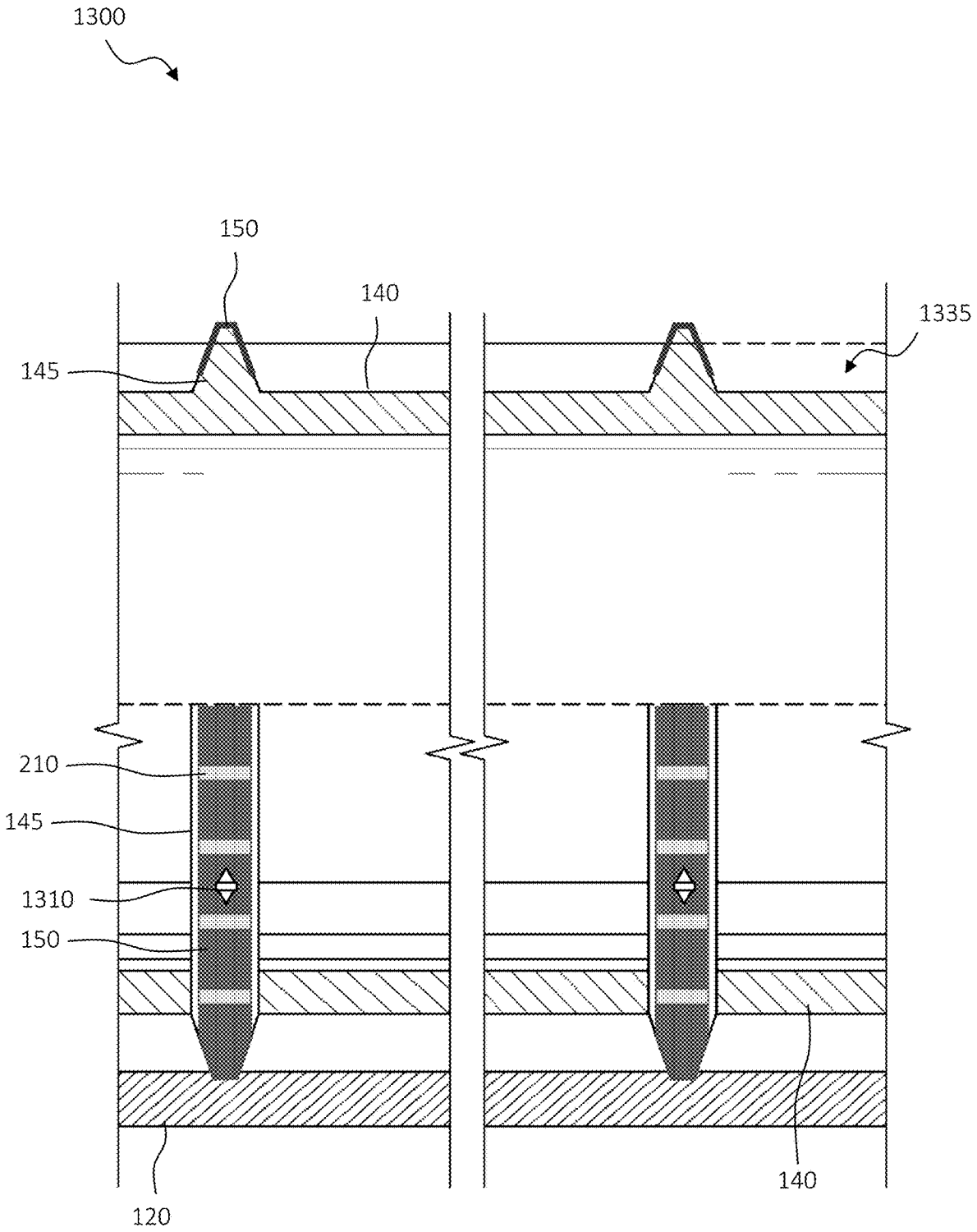

FIGS. 10B and 10C illustrate cross-sectional views of different embodiments of the C-ring, respectively, having the discrete slip teeth attached thereto, as might be designed, manufactured and/or employed according to the present disclosure FIGS. 11A and 11B illustrate various different expandable liner hanger assemblies designed, manufactured and operated according to one or more embodiments of the disclosure;

FIGS. 12A through 12J, illustrate various different embodiments of an expandable liner hanger assembly having a continuous anchoring ridge designed, manufactured, and placed according to one or more embodiments of the disclosure; and FIG. 13 illustrates an alternative embodiment of a well system including an expandable linger hanger assembly designed, manufactured and/or operated according to one or more embodiments of the disclosure.

DETAILED DESCRIPTION

In the drawings and descriptions that follow, like parts are typically marked throughout the specification and drawings with the same reference numerals, respectively. The drawn figures are not necessarily, but may be, to scale. Certain features of the disclosure may be shown exaggerated in scale or in somewhat schematic form and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results. Moreover, all statements herein reciting principles and aspects of the disclosure, as well as specific examples thereof, are intended to encompass equivalents thereof. Additionally, the term, "or," as used herein, refers to a non-exclusive or, unless otherwise indicated.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally away from the bottom, terminal end of a well, regardless of the wellbore orientation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical or horizontal axis. Unless otherwise specified, use of the term "subterranean formation" shall be construed as encompassing both areas below exposed earth and areas below earth covered by water, such as ocean or fresh water.

As can be appreciated, liner hangers (e.g., expanded liner hangers) should support the substantial weight of the attached tubing string below. For deep and extra-deep wells, subsea wells, etc., the tubing string places substantial axial load on the hanging mechanism engaging the liner hanger to the casing. There is a need for improved methods and apparatus providing a liner hanger having an anchoring mechanism and sealing mechanism capable of supporting the substantial axial loads imparted by longer and heavier liner strings. Furthermore, there is a need in certain situations to improve performance of liner hanger designs that have failed to achieve adequate axial load holding in an uphole direction when placed in collapse by pressure from downhole.

Additionally, the industry is currently employing high grade steels (e.g., with minimum yield strengths of 125 ksi, 140 ksi, 150 ksi, etc.), as well as increased wall thickness, for the wellbore tubular in many high pressure/high temperature applications. The present disclosure has recognized that the higher minimum yield strength and increased wall thickness leads to various problems. For example, the present disclosure has recognized that in such situations traditional anchoring ridges (e.g., with minimum yield strengths of 110 ksi or less) are unable to bite in the wellbore tubular, as well as are unable to deform the wellbore tubular (e.g., into a wave form), when expanded. Accordingly, the traditional anchoring ridges, particularly when used with high grade steel wellbore tubulars, can only rely on the metal-to-metal friction between the anchoring ridges and the wellbore tubular as the anchoring means. Unfortunately, in certain applications the metal-to-metal friction fails to provide the required anchoring capacity. Moreover, the traditional anchoring ridges, again particularly when used with high grade steel wellbore tubulars, fail to provide the necessary high pressure seal (e.g., from below).

The present disclosure has recognized, for the first time, that axial load performance of liner hangers can be improved by localized hardening of the one or more of the anchoring ridges. For example, the localized hardening of the one or more of the anchoring ridges allows the one or more ridges to expand, which would not be as possible if the entire continuous anchoring ridge was hardened. In at least one embodiment, one or more of the anchoring ridges are locally hardened, such that the locally hardened sections would have a minimum yield strength of at least 175 ksi, if not at least 200 ksi or at least 250 ksi. For example, in one or more embodiments one or more of the anchoring ridges are locally hardened, such that the locally hardened sections would have a minimum yield strength at least as high as the hardness of carburized steel (e.g., 300 ksi).

In at least one embodiment, one or more of the anchoring ridges are locally hardened using an additive manufacturing technique. For example, one or more of the anchoring ridges may be locally hardened using a direct metal deposition process, for example employing robotic arm(s) to deposit a thin metal having a minimum yield strength of at least 175 ksi to localized regions of the anchoring ridge.

In at least one other embodiment, one or more of the anchoring ridges are locally hardened using carburization. The term carburization (e.g., including carburizing, carburising, carburisation, etc.), as used herein, means a heat treatment process in which iron or steel absorbs carbon while the metal is heated in the presence of a carbon-bearing material, such as charcoal or carbon monoxide. The intent is to make the metal harder. Depending on the amount of time and temperature, the affected area can vary in carbon content. Longer carburizing times and higher temperatures typically increase the depth of carbon diffusion. Furthermore, when the iron or steel is cooled rapidly by quenching, the higher carbon content on the outer surface becomes hard due to the transformation from austenite to martensite, while the core remains soft and tough as a ferritic and/or pearlite microstructure.

The number of anchoring ridges having the locally hardened surface for a given design may vary. In at least one embodiment, one or more of the anchoring ridges have the locally hardened surface. In yet another embodiment, at least 20 percent of the anchoring ridges have the locally hardened surface, if not at least 50 percent of the anchoring ridges. In yet another embodiment, at least 75 percent of the anchoring ridges have the locally hardened surface, if not 100 percent.

The present disclosure has further recognized, for the first time, that axial load performance of liner hangers can be improved by replacing one or more of the continuous (e.g., circular) anchoring ridges with a ring of discrete slip teeth, each having a minimum yield strength of at least 175 ksi, if not at least 200 ksi, if not at least 250 ksi, or up to 300 ksi or above. In certain embodiments, less than all of the continuous anchoring ridges are replaced with the ring of discrete slip teeth. For example, the uphole and downhole most continuous anchoring ridges could be replaced with the ring of discrete slip teeth, every other continuous anchoring ridge replaced with the ring of discrete slip teeth, etc. Accordingly, the ring(s) of discrete slip teeth could be used to improve the anchoring capacity (e.g., the number of rings of discrete slip teeth could be chosen based upon the anchor load requirements of the well system), whereas the continuous anchoring ridges could be used for sealing capacity (e.g., the number of continuous anchoring ridges could be chosen based upon the sealing requirements of the well system).

In at least one embodiment, the discrete slip teeth may be placed within one or more shallow grooves in the radially expandable tubular. In one or more embodiments, the discrete slip teeth are each individually press fit within the one or more shallow grooves. In one or more other embodiments, the plurality of discrete slip teeth are coupled to a C-ring that is press fit within the one or more grooves. In yet another embodiment, the plurality of discrete slip teeth are coupled to each other using an elastic material that would hold the plurality of discrete slip teeth within the one or more shallow grooves. In even yet another embodiment, the plurality of slip teeth are coupled to an open end ring by way of inward pointing slender beams, the inward pointing slender beams holding the plurality of slip teeth within the one or more shallow grooves. Nevertheless, other coupling mechanisms, including adhesives and/or spot welds could be used to maintain the plurality of slip teeth within the one or more shallow grooves.

The embodiments disclosed above have been shown to greatly improve the anchoring capacity of the expandable liner hanger assembly. For example, finite element analysis (FEA) simulation of the embodiments discloses show that the anchoring capacity may be improved by at least 30%. Accordingly, a 1.5 m expandable liner hanger assembly according to the present disclosure could provide the same anchoring capacity as a 4 m traditional expandable liner hanger assembly.

Figure 1:
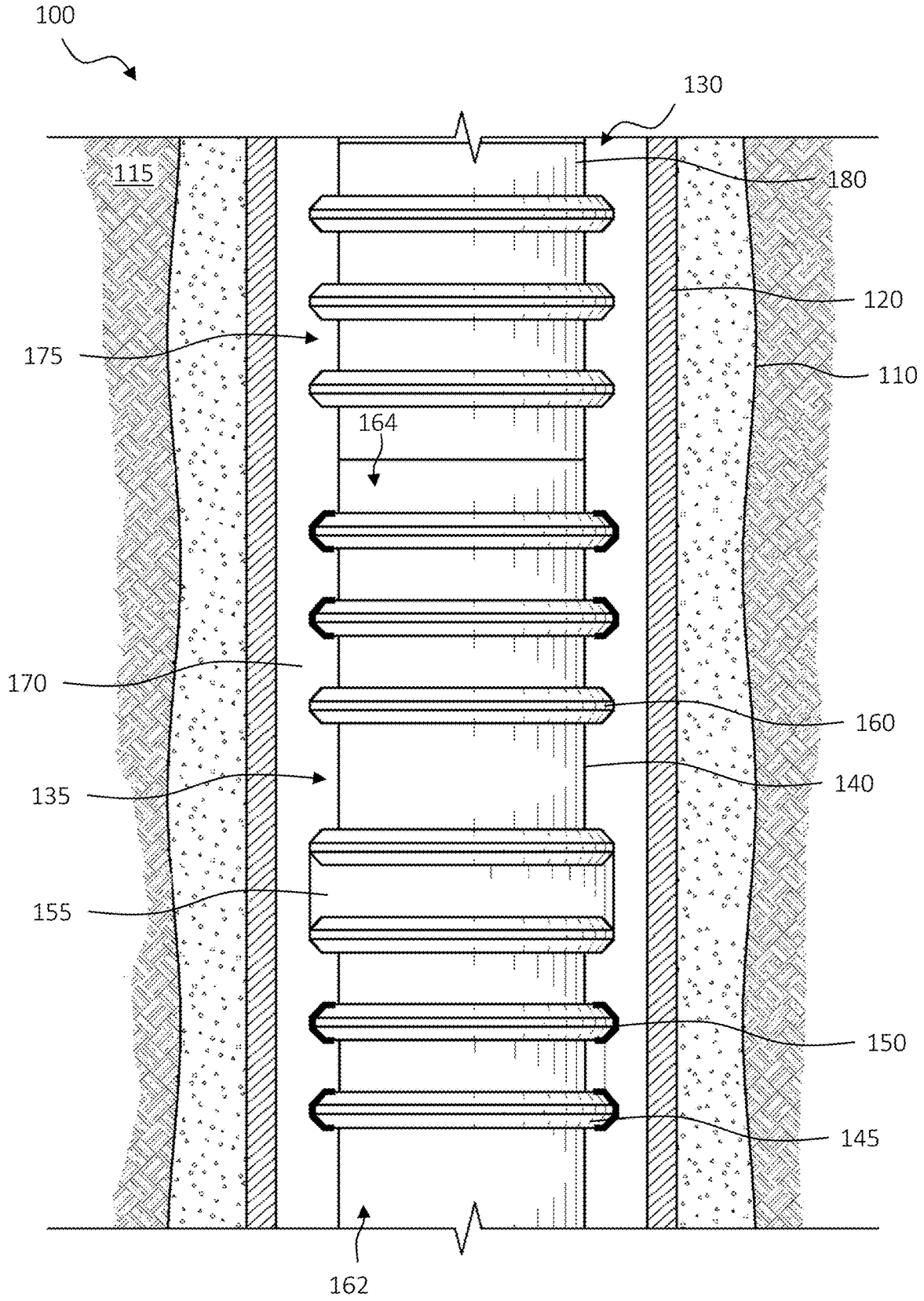
FIG. 1 illustrates one embodiment of a well system designed, manufactured and/or operated according to one or more embodiments of the disclosure.

FIG. 1 illustrates one embodiment of a well system 100 designed, manufactured and/or operated according to one or more embodiments of the disclosure. The well system 100, in at least one embodiment, includes a wellbore 110 extending through one or more hydrocarbon bearing subterranean formations 115. Further to the embodiment of FIG. 1, a wellbore tubular 120 (e.g., casing string in the illustrated embodiment) has been installed and cemented within the wellbore 110. The wellbore tubular 110 may comprise many different materials and minimum yield strengths and remain within the scope of the disclosure. Nevertheless, the present disclosure is particularly useful when the wellbore tubular 110 comprises a high grade steel. For instance, the wellbore tubular may have a minimum yield strength of at least 125 ksi in one embodiment, at least 140 ksi in another embodiment, at least 150 ksi in yet another embodiment, etc., and remain within the scope of the disclosure.

In the illustrated embodiment, a liner hanger system 130 (e.g., expandable liner hanger system) is positioned within the wellbore 110. The liner hanger system 130, in at least one embodiment, includes an expandable cone (not shown), as well as an expandable liner hanger assembly 135 disposed thereabout. In at least one embodiment, the expandable liner hanger assembly 135 includes a radially expandable tubular 140. In the illustrated embodiment, the radially expandable tubular 140 defines an interior passageway and an exterior surface. In accordance with one embodiment, the expandable liner hanger assembly 135 additionally includes one or more continuous anchoring ridges 145 extending radially outward from the radially expandable tubular 140. In accordance with one embodiment of the disclosure, the radially expandable tubular 140 is configured to move from an initial state (as shown) wherein the one or more continuous anchoring ridges 145 are not in contact with the wellbore tubular 120, to an expanded state (e.g., shown in FIG. 2) wherein the one or more anchoring ridges 145 are in gripping engagement with the wellbore tubular 120.

Further to the embodiment of FIG. 1, at least one of the one or more continuous anchoring ridges 145 has a plurality of localized hardened sections 150 placed circumferentially there around. Without limitation, the plurality of localized hardened sections 150 might have a minimum yield strength of at least 175 ksi, if not at least 200 ksi or at least 250 ksi. For example, in one or more embodiments, the plurality of locally hardened sections could have a minimum yield strength at least as high as the hardness of carburized steel (e.g., 300 ksi). The plurality of localized hardened sections 150 may be manufactured using any of the processes disclosed above, or any other known or hereafter discovered process.

As shown, the expandable liner hanger assembly 135 may be hung, extending downhole from a lower end of wellbore tubular 120. An annulus 170 may be created between the wellbore tubular 120 and the liner hanger system 130. In embodiments, the liner hanger system 130 can support additional wellbore casing, operational tubulars or tubing strings, completion strings, downhole tools, etc., for positioning at greater depths.

As used herein, the terms "tubular," "liner," and "casing" are used generally to describe tubular wellbore items, used for various purposes in wellbore operations. Tubulars, liners, and casings can be made from various materials (metal, plastic, composite, etc.), can be expanded or unexpanded as part of an installation procedure, and can be segmented or continuous. It is not necessary for a tubular, liner or casing to be cemented into position. Any type of tubular, liner, or casing may be used in keeping with the principles of the present invention.

As further illustrated in FIG. 1, the liner hanger system 130 may seal and secure an upper end of expandable liner hanger assembly 135 near a lower end of the wellbore tubular 120. Alternatively, the liner hanger system 130 may seal and secure the upper end of expandable liner hanger assembly 135 above a window (not shown) formed through a sidewall of the wellbore tubular 120, with the expandable liner hanger assembly 135 extending outwardly through the window into a branch or lateral wellbore. Thus, it will be appreciated that many different configurations and relative positions of the wellbore tubular 120 and the liner hanger system 130 are possible.

In embodiments, as also shown in FIG. 1, a setting tool 175 may be connected proximate the expandable liner hanger assembly 135 on work string 180. Work string 180 may convey the setting tool 175, expandable liner hanger assembly 135 (e.g., including the radially expandable tubular 140 and the one or more continuous anchoring ridges 145) into the wellbore 110, conduct fluid pressure and flow, transmit torque, tensile and compressive force, etc. Setting tool 175 may facilitate conveyance and installation of radially expandable tubular 140 and the one or more continuous anchoring ridges 145, in part by using the torque, tensile and compressive forces, fluid pressure and flow, etc., as delivered by work string 180.

In FIG. 1, the expandable liner hanger assembly 135 is additionally illustrated with one or more sealing members 155 and one or more anchoring ridges 160 positioned on and attached to the expandable liner hanger assembly 135. In at least one embodiment, the one or more anchoring ridges function as a primary metal-to-metal seal, whereas the one or more sealing members 155 function as a secondary seal. Additionally, in certain embodiments the radially expandable tubular 140 and the one or more continuous anchoring ridges 145 may also provide a sealing function. In accordance with one embodiment, the one or more anchoring ridges 160 may be standard anchoring ridges (e.g., that might not contain the plurality of localized hardened sections 150), but may be used in conjunction with the one or more continuous anchoring ridges 145 having the plurality of localized hardened sections 150. In embodiments, when the expandable liner hanger assembly 135 is expanded, such as with an expansion cone, into anchoring and sealing engagement with wellbore tubular 120, the one or more continuous anchoring ridges 145 having the plurality of localized hardened sections 150, the one or more sealing members 155, and the one or more anchoring ridges 160 engage the interior of wellbore tubular 120. In at least one embodiment, the one or more continuous anchoring ridges 145 having the plurality of localized hardened sections 150 and the one or more anchoring ridges 160 provide an anchoring function, whereas each of the one or more continuous anchoring ridges 145 having the plurality of localized hardened sections 150, the one or more sealing members 155, and the one or more anchoring ridges 160 provide a sealing function to one degree or another. These elements are discussed more fully below.

Figure 2:
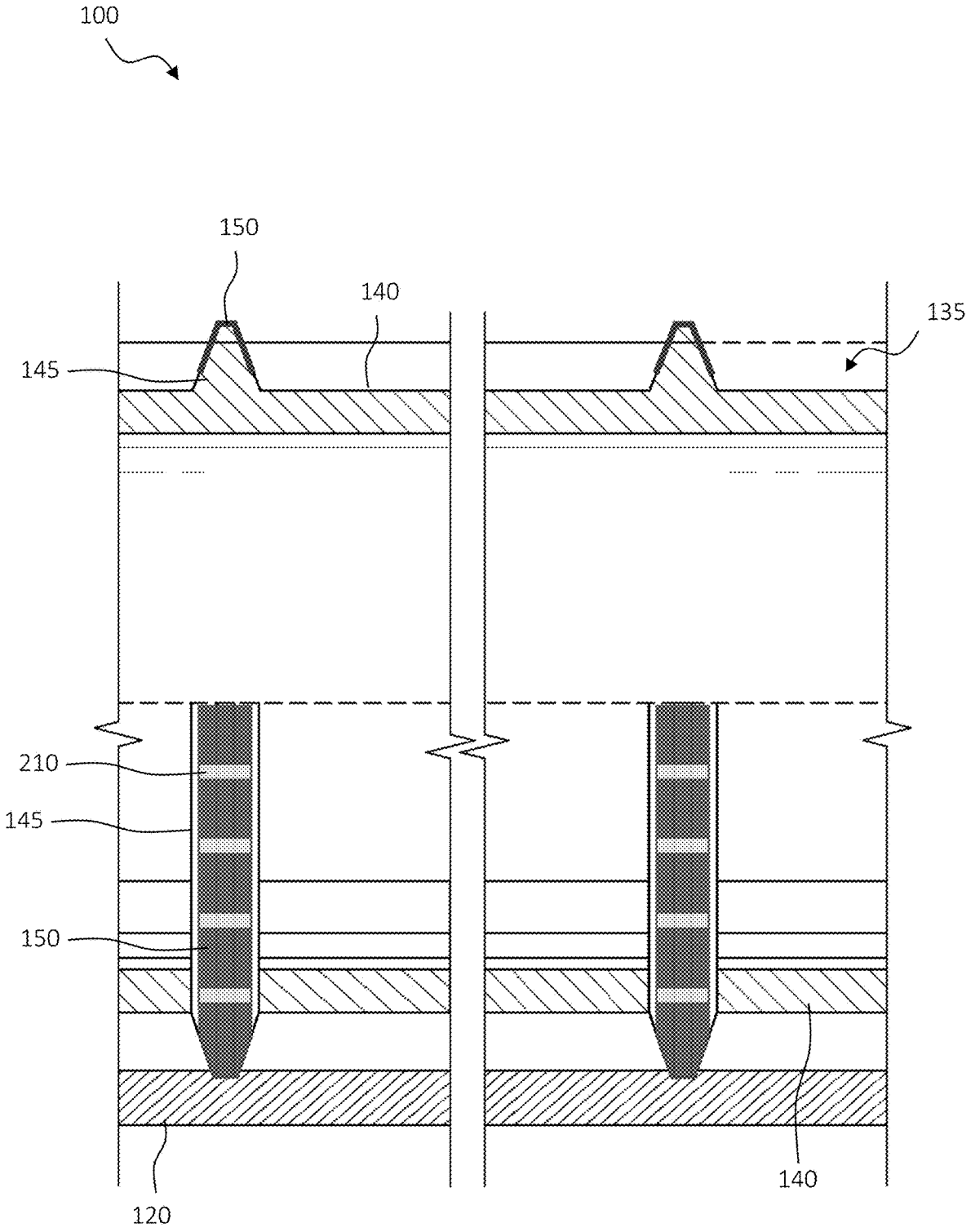
FIG. 2 illustrates an elevational view, with cut-away and partial cross-section, of an embodiment of the well system of FIG. 1, with the expandable liner hanger assembly in the expanded state.

FIG. 2 illustrates an elevational view, with cut-away and partial cross-section, of an embodiment of the well system 100 of FIG. 1, with the expandable liner hanger assembly 135 in the expanded state. Accordingly, the one or more continuous anchoring ridges 145 having the plurality of localized hardened sections 150 are in gripping engagement with the wellbore tubular 120. In at least one embodiment, as shown, the one or more continuous anchoring ridges 145 may have at least four localized hardened sections 150 placed circumferentially there around. In at least one embodiment, the at least four localized hardened sections 150 are placed circumferentially equidistance there around. In at least one other embodiment, the one or more continuous anchoring ridges 145 may have at least eighteen localized hardened sections 150 placed circumferentially there around, if not placed circumferentially equidistance there around. In yet another embodiment, the one or more continuous anchoring ridges 145 may have at least twenty-four localized hardened sections 150 placed circumferentially there around, if not placed circumferentially equidistance there around.

In the illustrated embodiment, the plurality of localized hardened sections 150 are a plurality of localized hardened layers placed circumferentially there around. In accordance with this embodiment, the plurality of localized hardened layers may have a thickness of 0.25 μm or less. In yet another embodiment, the plurality of hardened layers may have a thickness ranging from 0.025 μm to 0.076 μm.

In the illustrated embodiment, a plurality of ductile sections 210 are placed between the plurality of localized hardened sections 150. The plurality of ductile sections 210, in at least one embodiment, comprise the same material as the radially expandable tubular 140, but have not been locally hardened like the localized hardened sections 150. In yet another embodiment, the plurality of ductile sections 210 comprise a different material and minimum yield strength than the radially expandable tubular 140 and/or the localized hardened sections 150. In at least one embodiment, the plurality of localized hardened sections 150 have a hardened section minimum yield strength at least 10% greater than a ductile section minimum yield strength of the plurality of ductile sections 210. In yet another embodiment, the plurality of localized hardened sections 150 have a hardened section minimum yield strength at least 50% greater than a ductile section minimum yield strength of the plurality of ductile sections 210. In yet even another embodiment, the plurality of localized hardened sections 150 have a hardened section minimum yield strength at least 100% greater than a ductile section minimum yield strength of the plurality of ductile sections 210.

Figure 3:
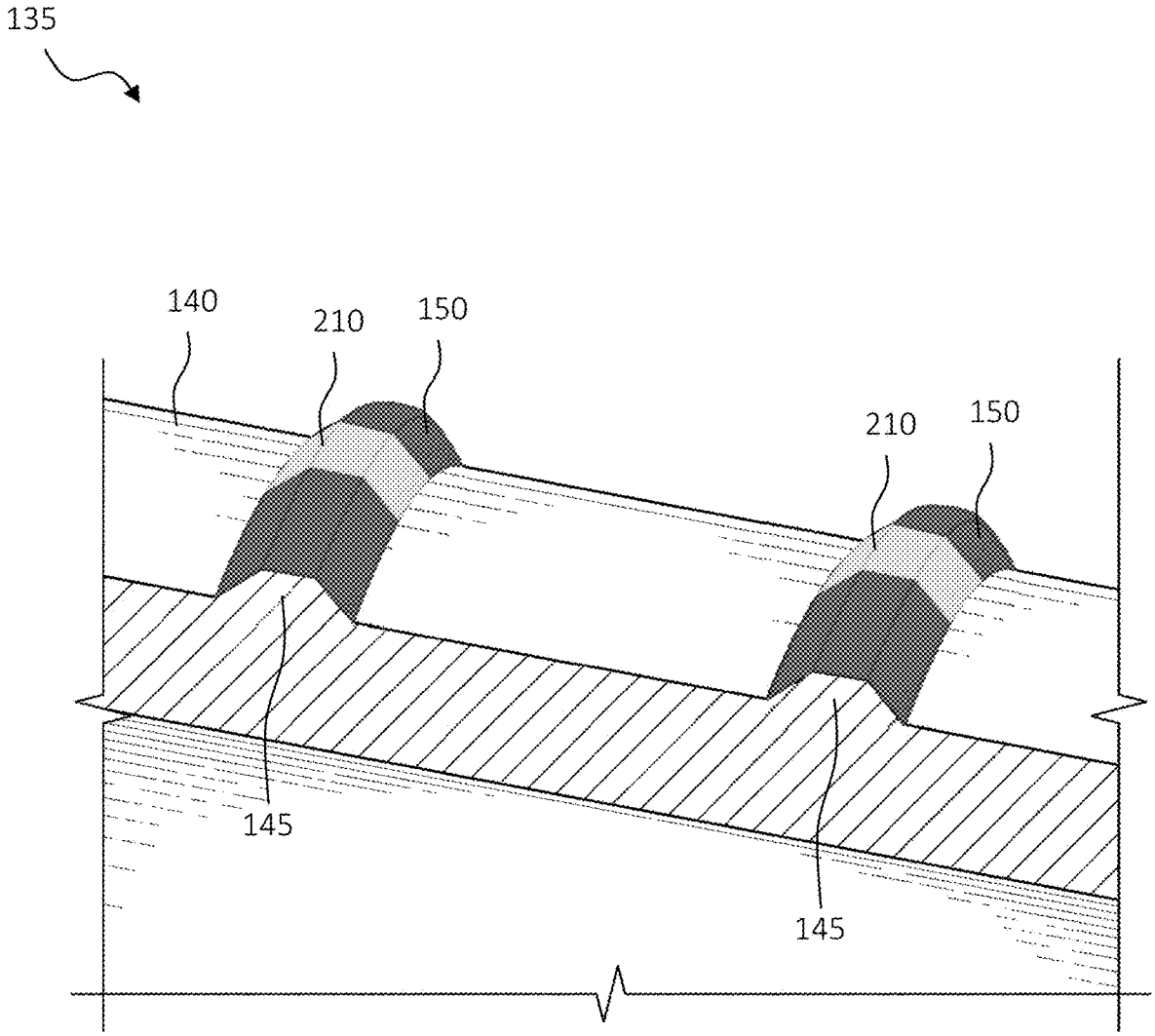
FIG. 3 illustrates a perspective view of expandable liner hanger assembly of FIGS. 1 and 2 with one or more (e.g., two) continuous anchoring ridges extending radially outward from the radially expandable tubular.

FIG. 3 illustrates a perspective view of expandable liner hanger assembly 135 of FIGS. 1 and 2 with one or more (e.g., two) continuous anchoring ridges 145 extending radially outward from the radially expandable tubular 140. As shown in FIG. 3, the one or more continuous anchoring ridges 145 have a plurality of localized hardened sections 150 placed circumferentially there around. In this embodiment, the radially expandable tubular 140 and the one or more continuous anchoring ridges 145 comprise the same material. Nevertheless, the plurality of localized hardened sections 150 provide the necessary minimum yield strength required to grip the wellbore tubular. The expandable liner hanger assembly 135 of FIG. 3 additionally includes the plurality of ductile sections 210.

Figure 4A:
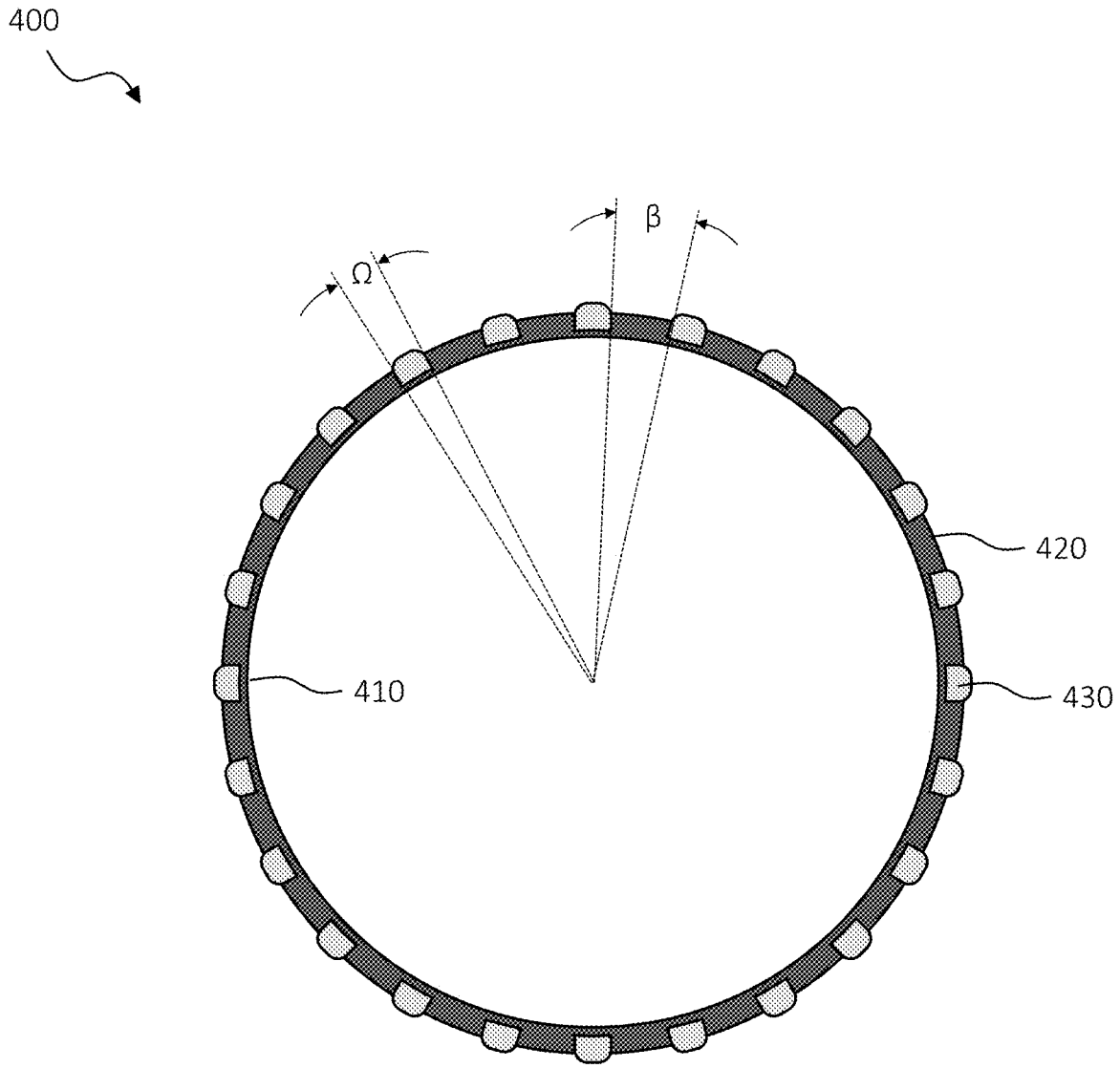
FIG. 4A illustrates a cross-section of an expandable liner hanger assembly designed, manufactured and/or operated, as might exist in its initial (e.g., non-expanded or run-in-hole) state.

FIG. 4A illustrates a cross-section of an expandable liner hanger assembly 400 designed, manufactured and/or operated, as might exist in its initial (e.g., non-expanded or run-in-hole) state. The expandable liner hanger assembly 400, in the illustrated embodiment of FIG. 4A, includes at least eighteen localized hardened sections 420 placed circumferentially around a radially expandable tubular 410. In the illustrated embodiment, the expandable liner hanger assembly 400 includes at least twenty-four localized hardened sections 420 placed circumferentially equidistance apart. Further to the embodiment of FIG. 4A, individual ones of ductile sections 430 are placed between the plurality of localized hardened sections 420. Further to the embodiment of FIG. 4A, in at least one embodiment, the plurality of ductile sections 430 are radially outside of the plurality of hardened sections 420 when the radially expandable tubular 400 is in the initial state.

In the illustrated embodiment, each of the localized hardened sections 420 extend circumferentially around the radially expandable tubular 410 by an angle (β), wherein the plurality of ductile sections 430 each extend circumferentially around the radially expandable tubular 410 an angle (Ω). In at least one embodiment, the angle (β) is 20 degrees or less, if not 10 degrees or less. In at least one other embodiment, the angle (Ω) is 10 degrees or less, if not 5 degrees or less. For example, a ratio of the angle (β) to the angle (Ω), in at least one embodiment, ranges from 4:1 to 1:1.

Figure 4B:
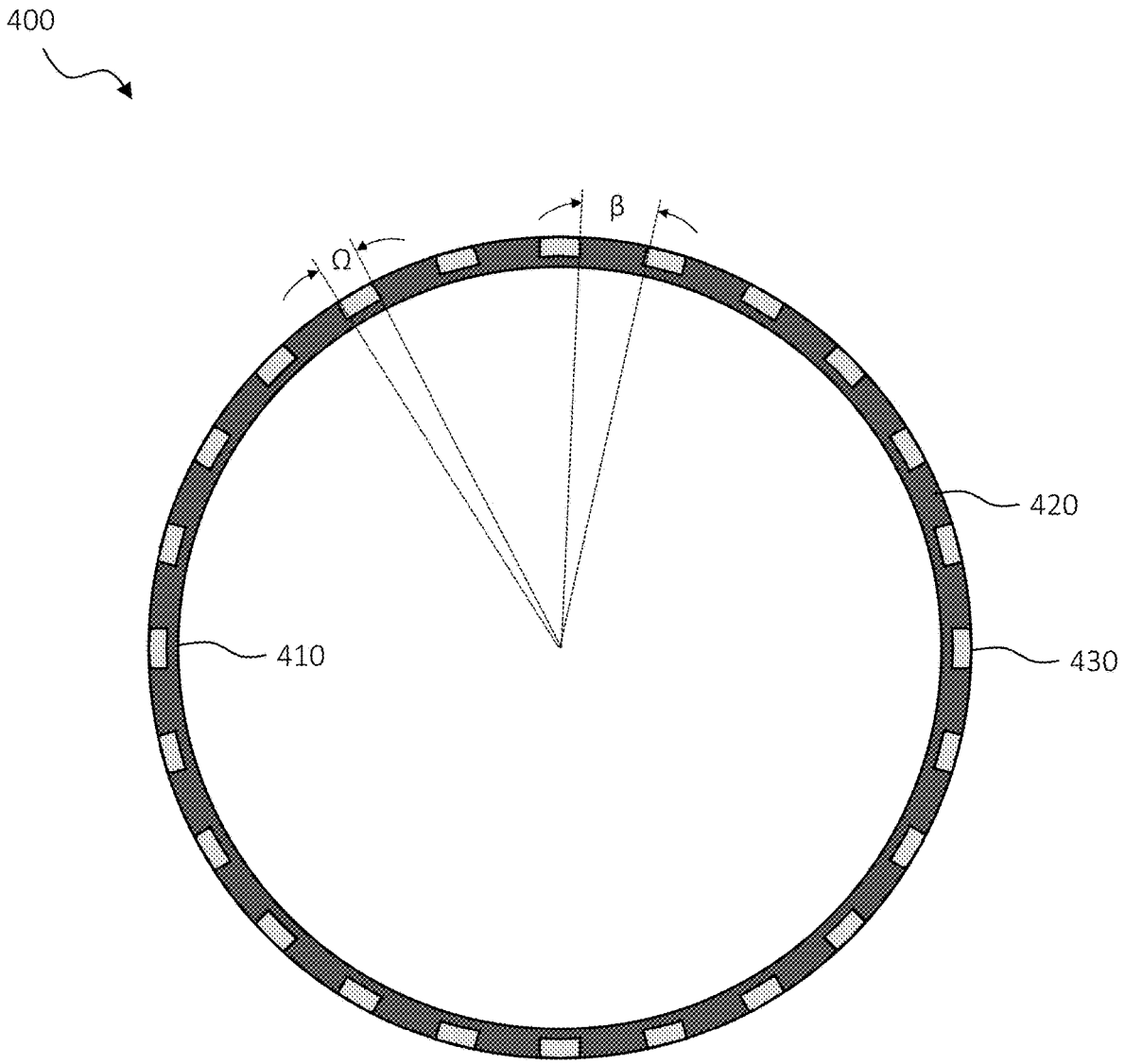
FIG. 4B illustrates a cross-section of the expandable liner hanger assembly of FIG. 4A, as it might exist in its expanded state.

FIG. 4B illustrates a cross-section of the expandable liner hanger assembly 400 of FIG. 4A, as it might exist in its expanded state. In at least one embodiment, as shown, the plurality of ductile sections 430 are no longer radially outside of the plurality of hardened sections 420 when the expandable liner hanger assembly 400 is in the expanded state.

Figure 4C:
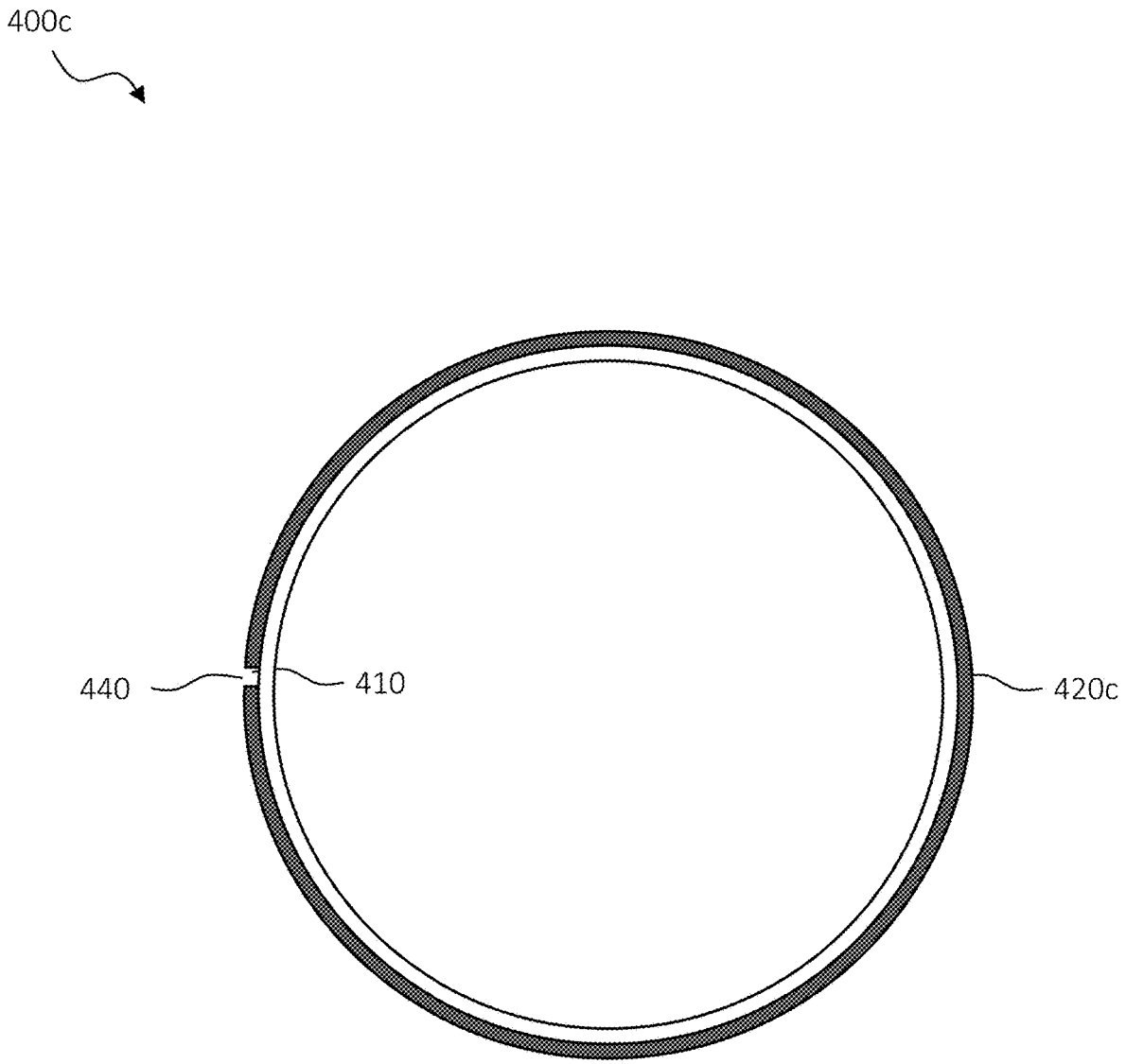
FIG. 4C illustrates a cross-section of an expandable liner hanger assembly designed, manufactured and/or operated according to an alternative embodiment, as might exist in its initial (e.g., non-expanded or run-in-hole) state.

FIG. 4C illustrates a cross-section of an expandable liner hanger assembly 400*c* designed, manufactured and/or operated, as might exist in its initial (e.g., non-expanded or run-in-hole) state. The expandable liner hanger assembly 400*c*, in the illustrated embodiment of FIG. 4A, includes a single hardened section 420*c* placed circumferentially around a radially expandable tubular 410. In the illustrated embodiment, the single hardened section 420*c* is set up as a C-ring with a cutout 440, which would allow the single hardened section 420*c* to expand.

Figure 4D:
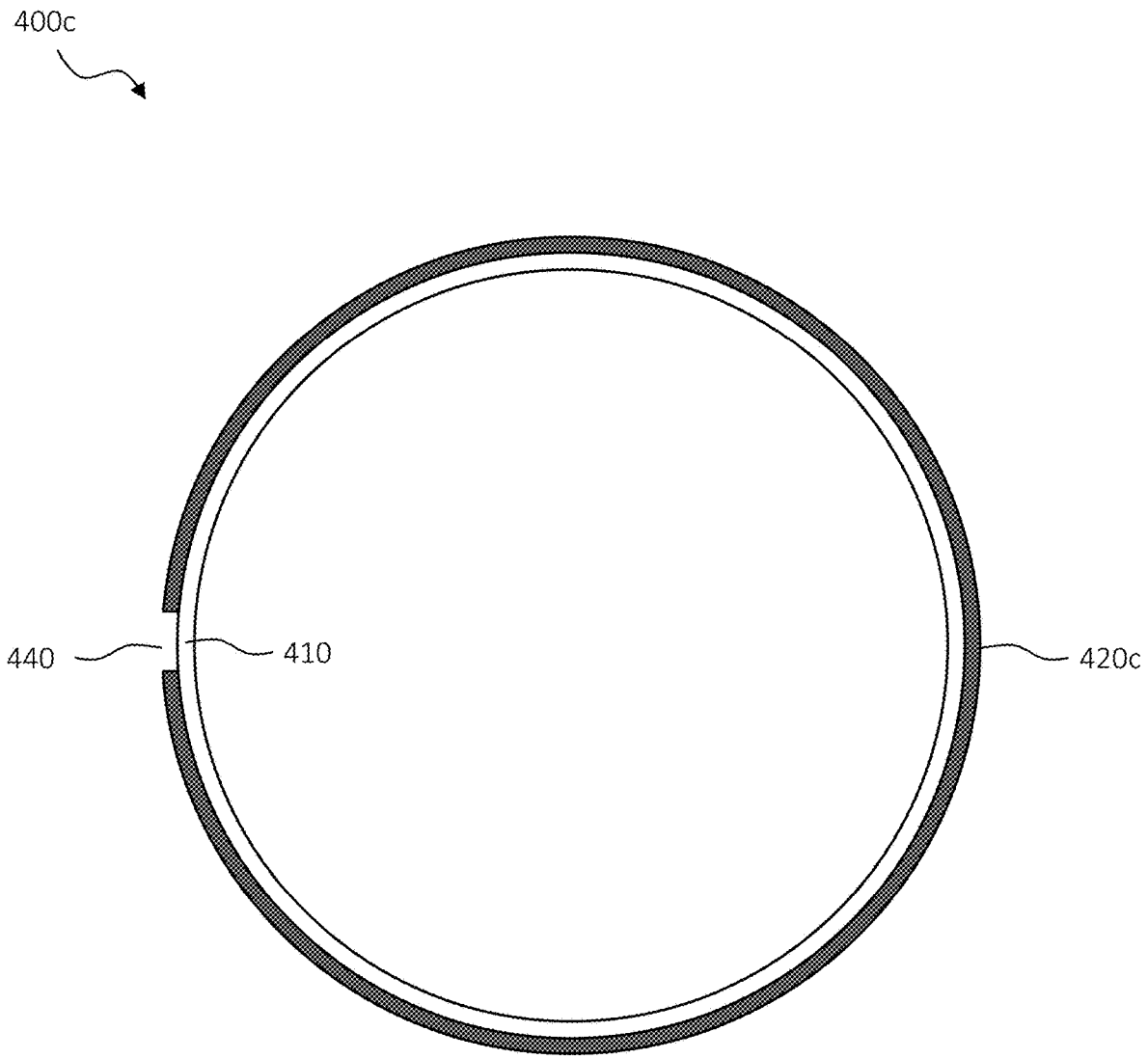
FIG. 4D illustrates a cross-section of the expandable liner hanger assembly of FIG. 4D, as it might exist in its expanded state.

FIG. 4D illustrates a cross-section of the expandable liner hanger assembly 400*c* of FIG. 4C, as it might exist in its expanded state.

Figure 5:
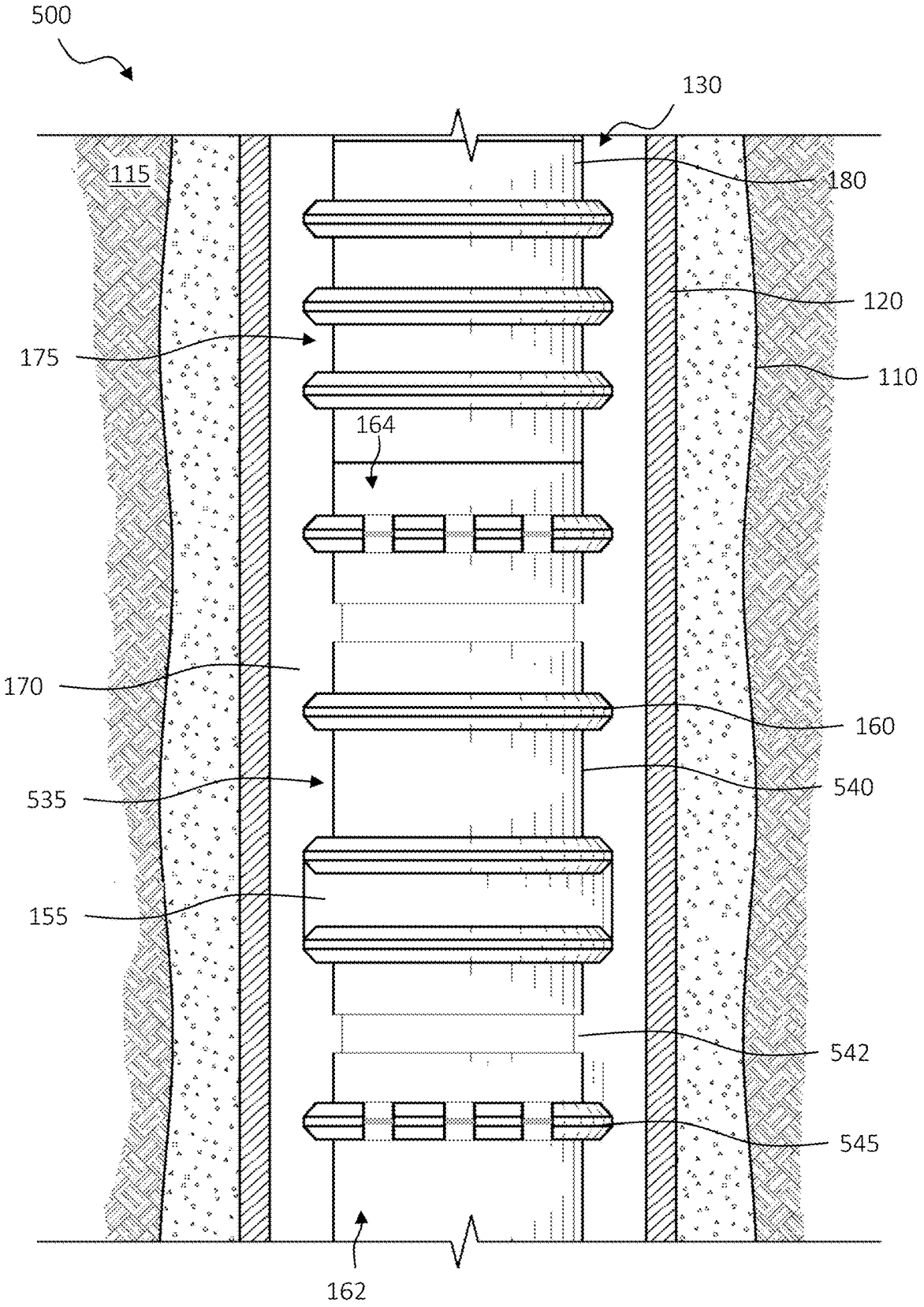
FIG. 5 illustrates an alternative embodiment of a well system designed, manufactured and/or operated according to one or more embodiments of the disclosure.

FIG. 5 illustrates an alternative embodiment of a well system 500 designed, manufactured and/or operated according to one or more embodiments of the disclosure. The well system 500 is similar in many respects to the well system 100 of FIG. 1. Accordingly, like reference number have been used to indicated similar, if not identical, features. The well system 500 differs, for the most part, from the well system 100, in that it employs a different expandable liner hanger assembly 535 from the expandable liner hanger assembly 135 of FIG. 1. For example, the expandable liner hanger assembly 535 does not include the one or more continuous anchoring ridges 145 having the plurality of localized hardened sections 150 placed circumferentially there around. In contrast, the expandable liner hanger assembly 535 of FIG. 5 includes a shallow groove 542 located in the exterior surface of its radially expandable tubular 540, and a plurality of discrete slip teeth 545 placed within the shallow groove 542 circumferentially around the radially expandable tubular 540. The plurality of discrete slip teeth 545 of the embodiment of FIG. 5 provide the same function as the one or more continuous anchoring ridges 145 having the plurality of localized hardened sections 150 placed circumferentially there around, which is to grip the wellbore tubular 120 when moved from the initial state to the expanded state.

In the illustrated embodiment of FIG. 5, each of the plurality of discrete slip teeth 545 has a minimum yield strength of at least 175 ksi. In yet another embodiment, each of the plurality of discrete slip teeth 545 has a minimum yield strength of at least 200 ksi, and in yet another embodiment each of the plurality of discrete slip teeth 545 has a minimum yield strength of at least 250 ksi, if not 300 ksi or more.

In the illustrated embodiment of FIG. 5, the expandable liner hanger assembly 535 includes at least four discrete slip teeth 545 placed circumferentially around the radially expandable tubular 540 in a given shallow groove 542. For example, the at least four discrete slip teeth 545 may be placed circumferentially equidistance around the radially expandable tubular 540 for a given shallow groove 542. In yet another embodiment, the expandable liner hanger assembly 535 includes at least eighteen discrete slip teeth 545 placed circumferentially (e.g., circumferentially equidistance) around the radially expandable tubular in a given shallow groove 542. In even yet another embodiment, the expandable liner hanger assembly 535 includes at least twenty-four discrete slip teeth 545 placed circumferentially (e.g., circumferentially equidistance) around the radially expandable tubular in a given shallow groove 542.

In certain embodiments, the radially expandable tubular 540 may include a plurality of spaced apart shallow grooves 542. In such an embodiment, a first set of plurality of discrete slip teeth could be positioned in a first shallow groove, and a second set of plurality of discrete slip teeth could be positioned in a second shallow groove, such as shown in FIG. 5. FIG. 5 further illustrates four different shallow grooves 542, two of which include sets of plurality of discrete slip teeth, and two of which have yet to include sets of plurality of discrete slip teeth. FIG. 5 additionally illustrates that one or more continuous anchoring ridges 160 may be positioned between the first and second sets of plurality of discrete slip teeth.

Figure 6:
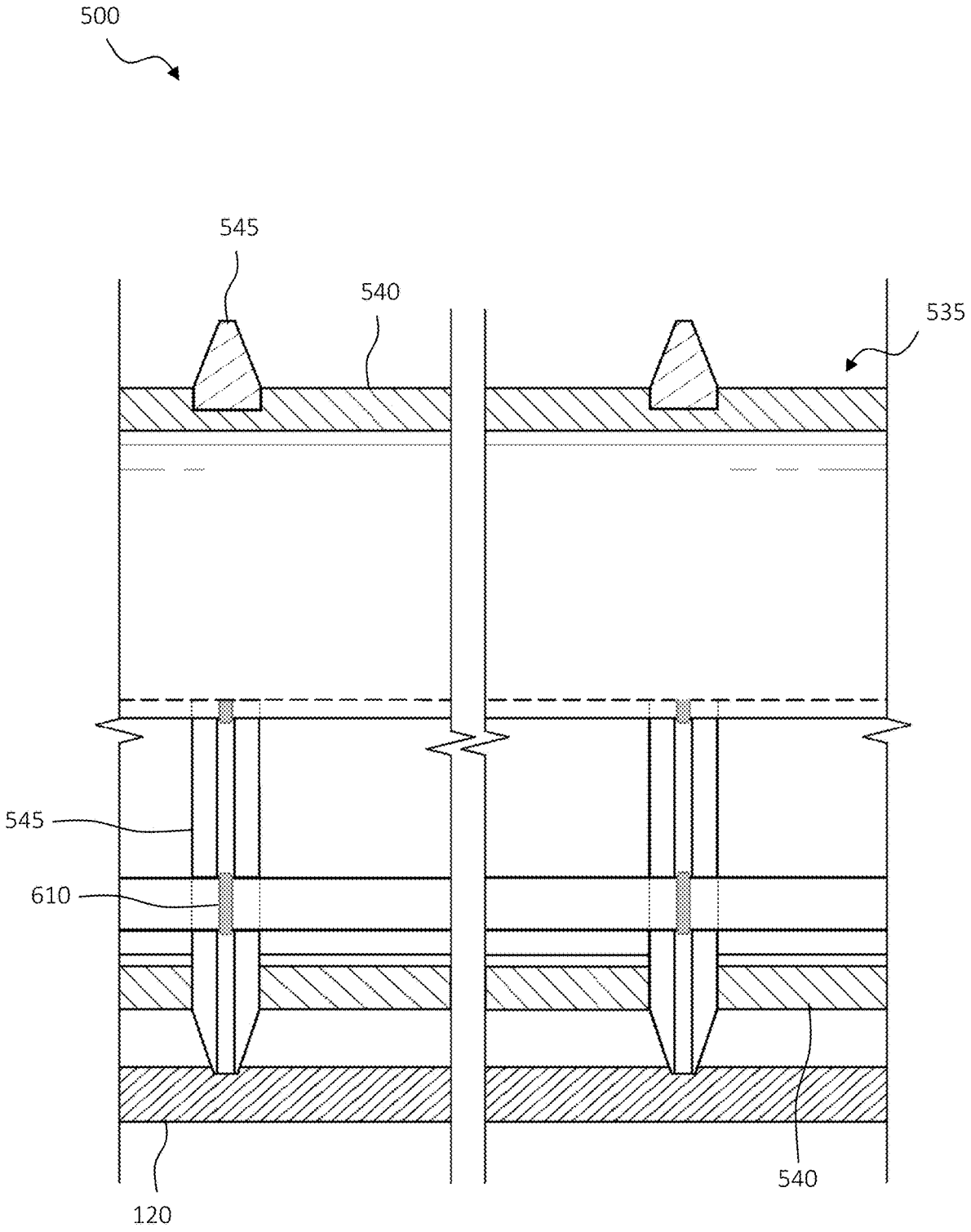
FIG. 6 illustrates an elevational view, with cut-away and partial cross-section, of an embodiment of the well system of FIG. 5, with the expandable liner hanger assembly in the expanded state.

FIG. 6 illustrates an elevational view, with cut-away and partial cross-section, of an embodiment of the well system 500 of FIG. 5, with the expandable liner hanger assembly 535 in the expanded state. Accordingly, the plurality of discrete slip teeth 545 are in gripping engagement with the wellbore tubular 120.

In certain embodiments, the plurality of discrete slip teeth 545 are individually press fit within the shallow grooves. Nevertheless, in the embodiment of FIG. 5, the plurality of discrete slip teeth 545 are coupled to each other using an elastic material 610 that holds the plurality of discrete slip teeth 545 within the shallow groove while the expandable liner hanger 535 is being run in hole, and until it is moved to the expanded state.

Figure 7:
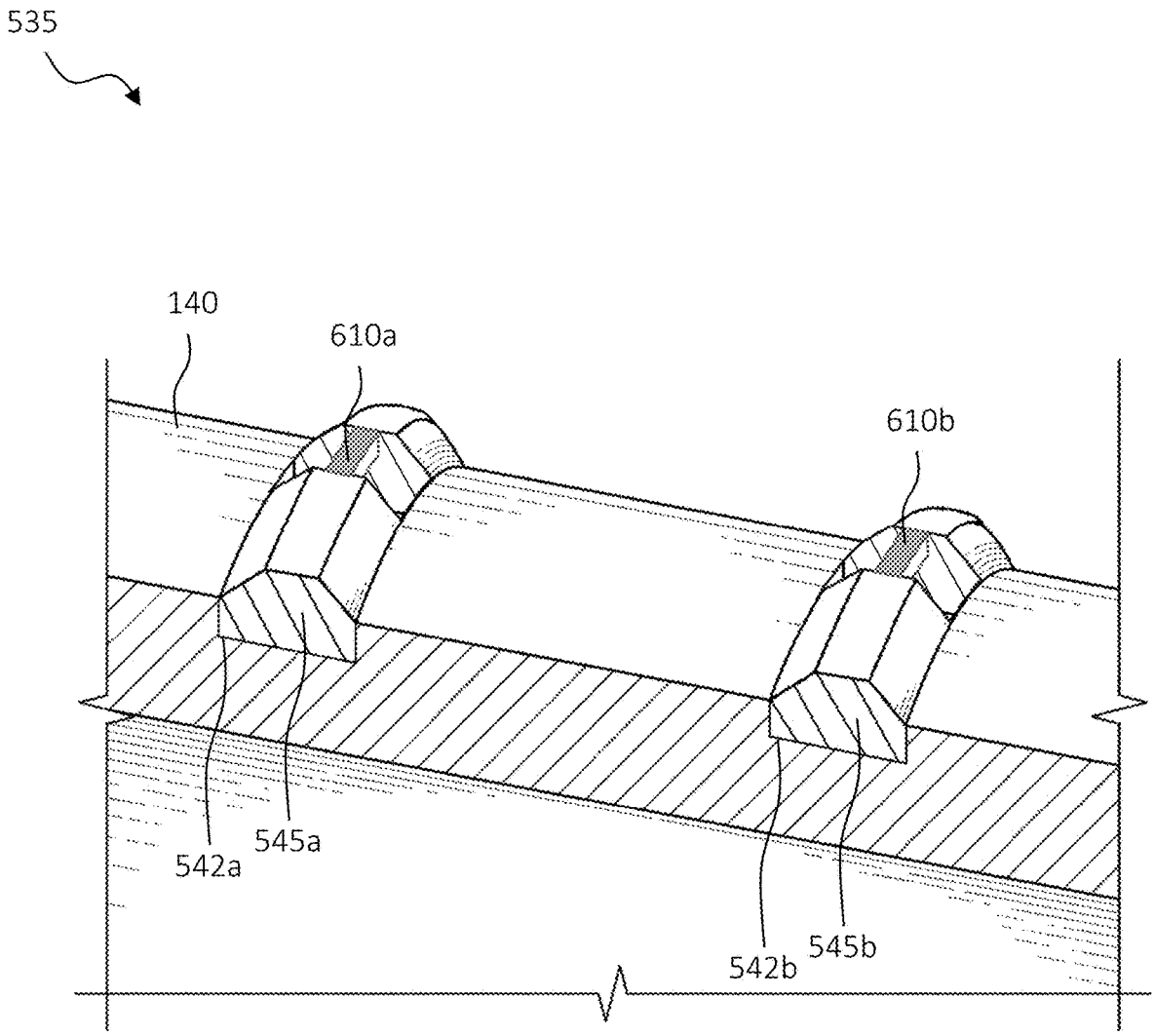
FIG. 7 illustrates a perspective view of expandable liner hanger assembly of FIGS. 5 and 6 with a first shallow groove including a first set of plurality of discrete slip teeth and a second shallow groove including a second set of plurality of discrete slip teeth.

FIG. 7 illustrates a perspective view of expandable liner hanger assembly 535 of FIGS. 5 and 6 with a first shallow groove 542*a* including a first set of plurality of discrete slip teeth 545*a* and a second shallow groove 542*b* including a second set of plurality of discrete slip teeth 545*b*. FIG. 7 further illustrates a first elastic material 610*a* that holds the first plurality of discrete slip teeth 545*a* within the first shallow groove 542*a*, and a second elastic material 610*b* that holds the second plurality of discrete slip teeth 545*b* within the first shallow groove 542*b*.

Figure 8A:
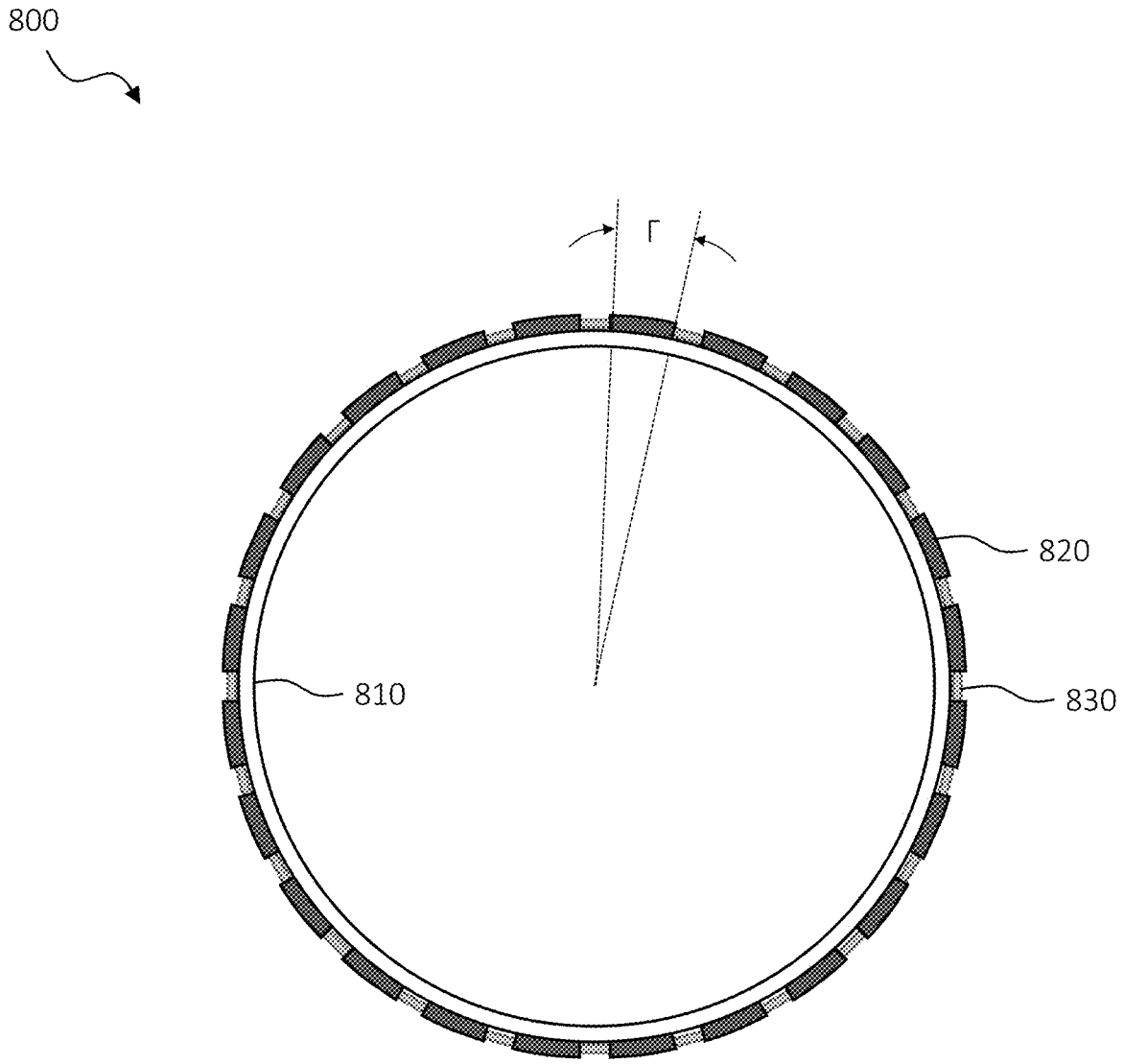
FIG. 8A illustrates a cross-section of an expandable liner hanger assembly designed, manufactured and/or operated, as might exist in its initial (e.g., non-expanded or run-in-hole) state.

FIG. 8A illustrates a cross-section of an expandable liner hanger assembly 800 designed, manufactured and/or operated, as might exist in its initial (e.g., non-expanded or run-in-hole) state. The expandable liner hanger assembly 800, in the illustrated embodiment, includes at least eighteen discrete slip teeth 820 placed within the shallow groove circumferentially around the radially expandable tubular 810. In the illustrated embodiment, the expandable liner hanger assembly 800 includes at least twenty-four discrete slip teeth 820 placed circumferentially equidistance apart. Further to the embodiment of FIG. 8A, elastic material 830 holds the plurality of discrete slip teeth 820 within the shallow groove.

In the illustrated embodiment, each of the discrete slip teeth 820 extend circumferentially around the radially expandable tubular by an angle (Γ). In at least one embodiment, the angle (Γ) is 30 degrees or less. In yet another embodiment, the angle (Γ) is 20 degrees or less, if not 10 degrees or less or 5 degrees or less.

Figure 8B:
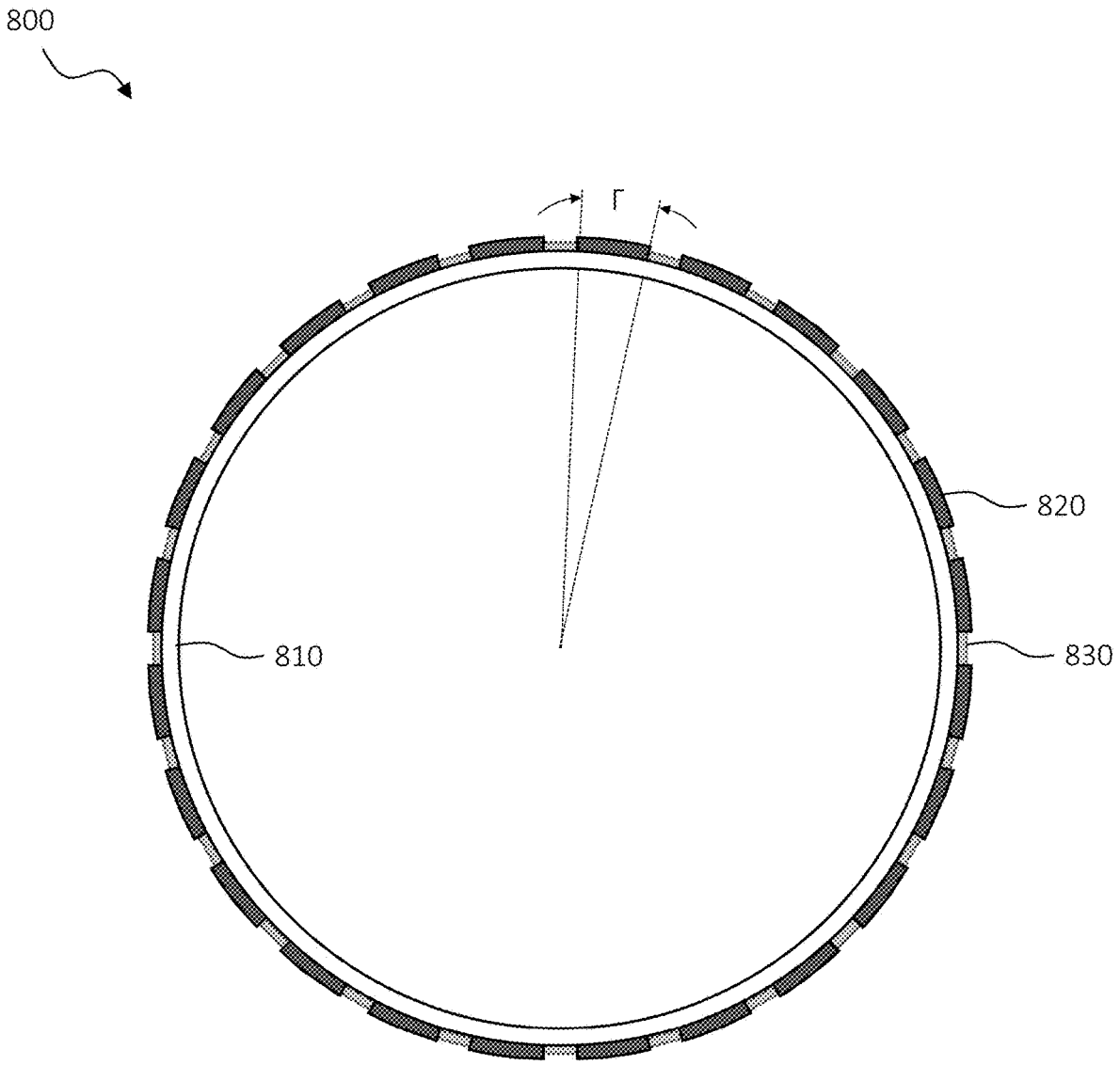
FIG. 8B illustrates a cross-section of the expandable liner hanger assembly of FIG. 8A, as it might exist in its expanded state.

FIG. 8B illustrates a cross-section of the expandable liner hanger assembly 800 of FIG. 8A, as it might exist in its expanded state.

Figure 9:
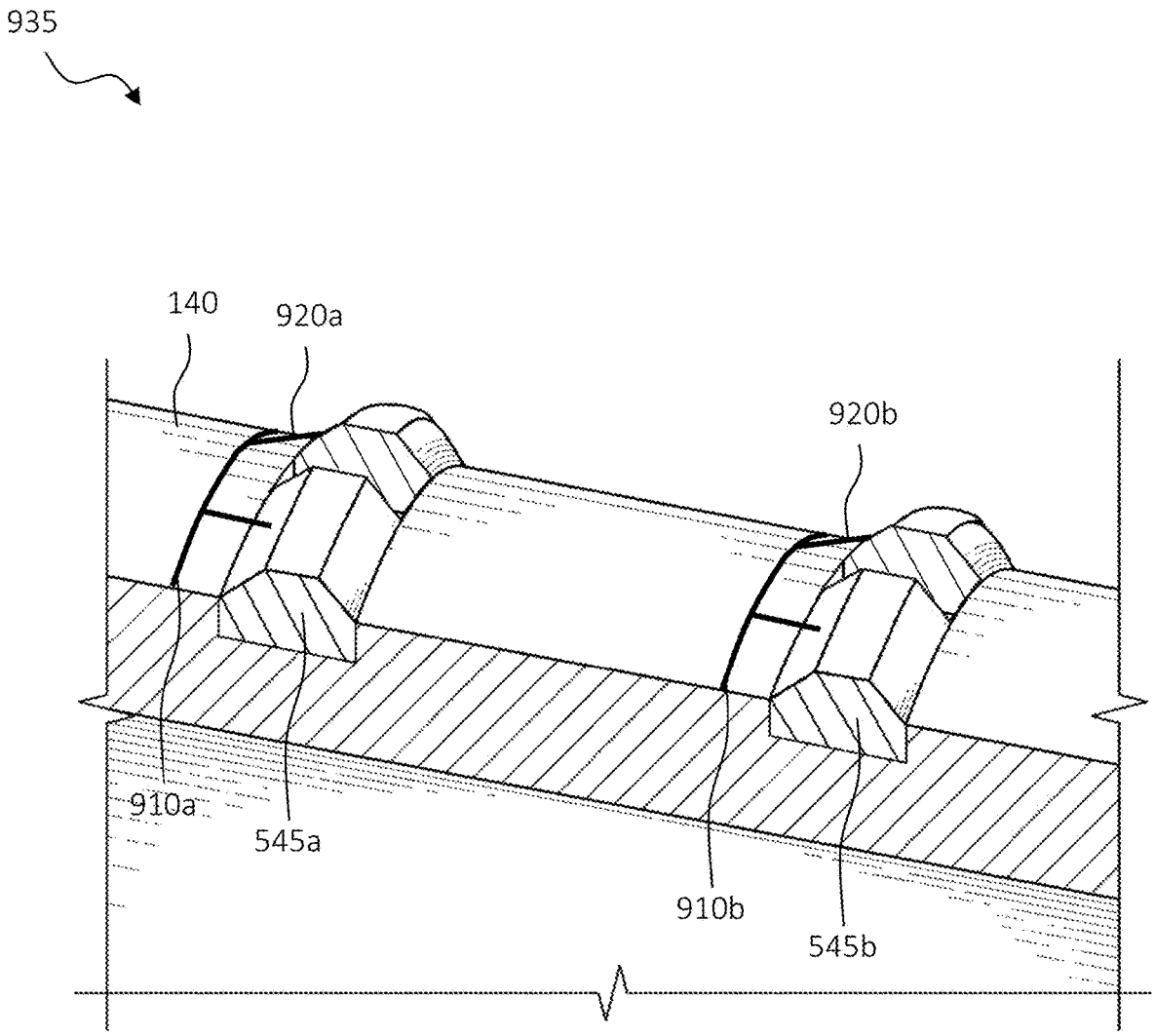
FIG. 9 illustrates a perspective view of an expandable liner hanger assembly, for example similar to the expandable liner hanger of FIGS. 5 and 6, but employing an open end ring and inward pointing slender beams coupled to ones of the discrete slip teeth to hold the plurality of discrete slip teeth within the shallow groove.

FIG. 9 illustrates a perspective view of an expandable liner hanger assembly 935, for example similar to the expandable liner hanger 535 of FIGS. 5 and 6, but employing an open end ring 910 and inward pointing slender beams 920 coupled to ones of the discrete slip teeth 545 to hold the plurality of discrete slip teeth 545 within the shallow groove.

FIG. 10A illustrates a perspective view of an expandable liner hanger assembly 1035, for example similar to the expandable liner hanger of FIGS. 5 and 6, but employing a C-ring 1010 attached to the discrete slip teeth 545 to hold the plurality of discrete slip teeth 545 within the shallow groove.

FIGS. 10B and 10C illustrate cross-sectional views of different embodiments of the C-ring 1010*b*, 1010*c*, respectively, having the discrete slip teeth 545 attached thereto, as might be designed, manufactured and/or employed according to the present disclosure.

Generally, in the downhole setting, elements with pressure from above (uphole) are typically "boosted" or enhanced because of the pressure on the inner diameter of the liner hanger. Elements with pressure from below (downhole) are typically placed in collapse, thus reducing the contact stress and liner hanger performance when reacting to load from below (downhole). The pressure from below (downhole) may be sealed off by placing one or more sealing members 1110 on the bottom of expandable liner hanger 1100—thus limiting the influence of collapse pressure—as illustrated in FIG. 11A. Further, trapped pressure from expansion of expandable liner hanger 1100, which would have a negative influence in the annular space between sealing members 1110, may be avoided—thus avoiding decreased performance of one or more anchoring ridges 1120. This may be due to fluid being able to communicate through stress-relief features in the one or more anchoring ridges 1120. Therefore, stress-relief features may provide stress relief and fluid communication. In another embodiment, as illustrated in FIG. 11B another sealing sub-assembly may be placed above the one or more anchoring ridges 1120 as well, thereby limiting the ability of pressure to reduce contact stress against the wellbore tubular. In certain scenarios, pressures may be directed from below (downhole) or above (uphole) and/or combined with varying internal pressures—all of which may impact the contact stress that expandable liner hanger 1100 has against the inner diameter of wellbore tubular. It should be noted, however, that the one or more anchoring ridges 1120, to one degree or another, may also provide a sealing function.

Turning to FIG. 12A, illustrated is one embodiment of an expandable liner hanger assembly 1200*a* having a continuous anchoring ridge 1210*a* designed, manufactured, and placed according to one or more embodiments of the disclosure. In the embodiment of FIG. 12A, the continuous anchoring ridge 1210*a* includes a localized hardened section 1220*a* positioned only on its top surface. The continuous anchoring ridge 1210*a*, in the illustrated embodiment, includes two inward angled sidewalls and a flat top surface.

Turning to FIG. 12B, illustrated is an alternative embodiment of an expandable liner hanger assembly 1200*b* having a continuous anchoring ridge 1210*b* designed, manufactured, and placed according to one or more embodiments of the disclosure. In the embodiment of FIG. 12B, the continuous anchoring ridge 1210*b* includes a localized hardened section 1220*b* positioned on its top surface and partially along its two inward angled sidewalls.

Turning to FIG. 12C, illustrated is an alternative embodiment of an expandable liner hanger assembly 1200*c* having a continuous anchoring ridge 1210*c* designed, manufactured, and placed according to one or more embodiments of the disclosure. In the embodiment of FIG. 12C, the continuous anchoring ridge 1210*c* includes a localized hardened section 1220*c* positioned on its top surface and entirely along its two inward angled sidewalls.

Turning to FIG. 12D, illustrated is an alternative embodiment of an expandable liner hanger assembly 1200*d* having a continuous anchoring ridge 1210*d* designed, manufactured, and placed according to one or more embodiments of the disclosure. In the embodiment of FIG. 12D, the continuous anchoring ridge 1210*d* includes two inward angled sidewalls, two vertical sidewalls, and a flat top surface, and the localized hardened section 1220*d* is positioned on its top surface and partially along its two sidewalls.

Turning to FIG. 12E, illustrated is an alternative embodiment of an expandable liner hanger assembly 1200*e* having a continuous anchoring ridge 1210*e* designed, manufactured, and placed according to one or more embodiments of the disclosure. In the embodiment of FIG. 12E, the continuous anchoring ridge 1210*e* includes two vertical sidewalls and a flat top surface, and the localized hardened section 1220*e* is positioned on its top surface and partially along its vertical two sidewalls.

Turning to FIG. 12F, illustrated is an alternative embodiment of an expandable liner hanger assembly 1200*f* having a continuous anchoring ridge 1210*f* designed, manufactured, and placed according to one or more embodiments of the disclosure. In the embodiment of FIG. 12F, the continuous anchoring ridge 1210*f* includes two outward angled sidewalls and a flat top surface, and the localized hardened section 1220*f* is positioned on its top surface and partially along its two outward angled sidewalls.

Turning to FIG. 12G, illustrated is an alternative embodiment of an expandable liner hanger assembly 1200*g* having a continuous anchoring ridge 1210*g* designed, manufactured, and placed according to one or more embodiments of the disclosure. In the embodiment of FIG. 12G, the continuous anchoring ridge 1210*g* includes two inward differently angled sidewalls, two vertical sidewalls, and a flat top surface, and the localized hardened section 1220*g* is positioned on its top surface and partially along its two inward angled sidewalls.

Turning to FIG. 12H, illustrated is an alternative embodiment of an expandable liner hanger assembly 1200*h* having a continuous anchoring ridge 1210*h* designed, manufactured, and placed according to one or more embodiments of the disclosure. In the embodiment of FIG. 12H, the continuous anchoring ridge 1210*h* includes two inward angled sidewalls, and a concave top surface, and the localized hardened section 1220*h* is positioned on its concave top surface and partially along its two sidewalls.

Turning to FIG. 12I, illustrated is an alternative embodiment of an expandable liner hanger assembly 1200*i* having a continuous anchoring ridge 1210*i* designed, manufactured, and placed according to one or more embodiments of the disclosure. In the embodiment of FIG. 12I, the continuous anchoring ridge 1210*i* includes two inward angled sidewalls forming a triangle, and the localized hardened section 1220*g* is positioned partially along its two inward angled sidewalls.

Turning to FIG. 12J, illustrated is an alternative embodiment of an expandable liner hanger assembly 1200*j* having a continuous anchoring ridge 1210*j* designed, manufactured, and placed according to one or more embodiments of the disclosure. In the embodiment of FIG. 12J, the continuous anchoring ridge 1210*j* includes a circular cross-section, and the localized hardened section 1220*g* is positioned on a top of the circular cross-section. It should be noted that the shapes of the continuous anchoring ridges illustrated in FIGS. 12A through 12J are equally suitable for the plurality of discrete slip teeth disclosed above.

Turning to FIG. 13, illustrated is an alternative embodiment of a well system 1300 including an expandable linger hanger assembly 1335 designed, manufactured and/or operated according to one or more embodiments of the disclosure. The expandable linger hanger assembly 1335 is similar in many respects to the expandable linger hanger assembly 135 of FIG. 2. Accordingly, like reference numbers have been used to indicate similar, if not identical, features. The expandable liner hanger assembly 1335 differs, for the most part, from the expandable linger hanger assembly 135, in that the expandable liner hanger assembly 1335 includes one or more stress-relief features 1310 defined thereon. In embodiments, a stress-relief groove or similar feature may be provided to support plastic expansion. Stress-relief features 1310 may be notches or cut-outs spaced circumferentially on one or more anchoring ridges 145, as shown. Further, stress-relief features 1310 may be created through milling. Those of skill in the art will recognize other stress-relief features and geometries as well. Stress-relief features 1310 may also allow for fluid communication between one or more anchoring ridges 145.

Aspects disclosed herein include:

A. An expandable liner hanger assembly, the expandable liner hanger assembly including: 1) a radially expandable tubular defining an interior passageway and an exterior surface; and 2) one or more continuous anchoring ridges extending radially outward from the radially expandable tubular, at least one of the one or more continuous anchoring ridges having a plurality of localized hardened sections placed circumferentially there around, the radially expandable tubular configured to move from an initial state wherein the one or more continuous anchoring ridges are not in contact with a wellbore tubular to an expanded state wherein the one or more continuous anchoring ridges are in gripping engagement with the wellbore tubular.

B. A well system, the well system including: 1) a wellbore extending through one or more subterranean formations; 2) wellbore tubular positioned within the wellbore; and 3) an expandable liner hanger assembly positioned within the wellbore tubular, the expandable liner hanger assembly including: a) a radially expandable tubular defining an interior passageway and an exterior surface; and b) one or more continuous anchoring ridges extending radially outward from the radially expandable tubular, at least one of the one or more continuous anchoring ridges having a plurality of localized hardened sections placed circumferentially there around, the radially expandable tubular configured to move from an initial state wherein the one or more continuous anchoring ridges are not in contact with the wellbore tubular to an expanded state wherein the one or more continuous anchoring ridges are in gripping engagement with the wellbore tubular.

C. An expandable liner hanger assembly, the expandable liner hanger assembly including: 1) a radially expandable tubular defining an interior passageway and an exterior surface, the radially expandable tubular having a shallow groove located in the exterior surface; and 2) a plurality of discrete slip teeth placed within the shallow groove circumferentially around the radially expandable tubular, the radially expandable tubular configured to move from an initial state wherein the plurality of discrete slip teeth are not in contact with a wellbore tubular to an expanded state wherein the plurality of discrete slip teeth are in gripping engagement with the wellbore tubular.

D. A well system, the well system including: 1) a wellbore extending through one or more subterranean formations; 2) wellbore tubular positioned within the wellbore; and 3) an expandable liner hanger assembly positioned within the wellbore tubular, the expandable liner hanger assembly including: a) a radially expandable tubular defining an interior passageway and an exterior surface, the radially expandable tubular having a shallow groove located in the exterior surface; and b) a plurality of discrete slip teeth placed within the shallow groove circumferentially around the radially expandable tubular, the radially expandable tubular configured to move from an initial state wherein the plurality of discrete slip teeth are not in contact with a wellbore tubular to an expanded state wherein the plurality of discrete slip teeth are in gripping engagement with the wellbore tubular.

Aspects A, B, C and D may have one or more of the following additional elements in combination: Element 1: wherein the at least one of the one or more continuous anchoring ridges has at least four localized hardened sections placed circumferentially there around. Element 2: wherein the at least four localized hardened sections are placed circumferentially equidistance there around. Element 3: wherein the at least one of the one or more continuous anchoring ridges has at least eighteen localized hardened sections placed circumferentially there around. Element 4: wherein the at least eighteen localized hardened sections are placed circumferentially equidistance there around. Element 5: wherein the at least one of the one or more continuous anchoring ridges has a plurality of ductile sections placed between the plurality of localized hardened sections. Element 6: wherein the at least eighteen localized hardened sections each extend circumferentially around the radially expandable tubular an angle (β) of 10 degrees or less. Element 7: wherein the plurality of ductile sections each extend circumferentially around the radially expandable tubular an angle (Ω) of 5 degrees or less. Element 8: wherein a ratio of the angle (β) to the angle (Ω) ranges from 4:1 to 1:1. Element 9: wherein the plurality of localized hardened sections have a hardened section minimum yield strength at least 10% greater than a ductile section minimum yield strength of the plurality of ductile sections. Element 10: wherein the plurality of localized hardened sections have a hardened section minimum yield strength at least 50% greater than a ductile section minimum yield strength of the plurality of ductile sections. Element 11: wherein the plurality of localized hardened sections have a hardened section minimum yield strength at least 100% greater than a ductile section minimum yield strength of the plurality of ductile sections. Element 12: wherein the plurality of ductile sections are radially outside of the plurality of hardened sections when the radially expandable tubular is in the initial state. Element 13: wherein the plurality of localized hardened sections are a plurality of localized hardened layers placed circumferentially there around. Element 14: wherein the plurality of hardened layers have a thickness of 0.25 μm or less. Element 15: wherein the plurality of hardened layers have a thickness ranging from 0.025 μm to 0.076 μm. Element 16: wherein each of the plurality of discrete slip teeth has a minimum yield strength of at least 175 ksi. Element 17: wherein each of the plurality of discrete slip teeth has a minimum yield strength of at least 200 ksi. Element 18: wherein each of the plurality of discrete slip teeth has a minimum yield strength of at least 250 ksi. Element 19: wherein the plurality of discrete slip teeth are at least four discrete slip teeth placed circumferentially around the radially expandable tubular. Element 20: wherein the at least four discrete slip teeth are placed circumferentially equidistance around the radially expandable tubular. Element 21: wherein the plurality of discrete slip teeth are at least eighteen discrete slip teeth placed circumferentially around the radially expandable tubular. Element 22: wherein the at least eighteen discrete slip teeth are placed circumferentially equidistance around the radially expandable tubular. Element 23: wherein the at least eighteen discrete slip teeth each extend circumferentially around the radially expandable tubular an angle (Γ) of 10 degrees or less. Element 24: wherein the plurality of discrete slip teeth are each individually press fit within the shallow groove. Element 25: wherein the plurality of discrete slip teeth are configured as a C-ring that is press fit within the shallow groove. Element 26: wherein the plurality of discrete slip teeth are coupled to each other using an elastic material that holds the plurality of discrete slip teeth within the shallow groove. Element 27: wherein the plurality of discrete slip teeth are coupled to an open end ring by way of inward pointing slender beams, the inward pointing slender beams holding the plurality of discrete slip teeth within the shallow groove. Element 28: wherein the shallow groove is a first shallow groove and the plurality of discrete slip teeth are a first set of plurality of discrete slip teeth, and further including a second shallow groove located in the exterior surface and a second set of plurality of discrete slip teeth placed within the second shallow groove circumferentially around the radially expandable tubular. Element 29: further including one or more continuous anchoring ridges extending radially outward from the radially expandable tubular. Element 30: wherein the one or more continuous anchoring ridges are positioned between the first set of plurality of discrete slip teeth and the second set of plurality of discrete slip teeth.

Those skilled in the art to which this application relates will appreciate that other and further additions, deletions, substitutions and modifications may be made to the described embodiments.

What is claimed is:

1. An expandable liner hanger assembly, comprising:

a radially expandable tubular defining an interior passageway and an exterior surface; and one or more continuous anchoring ridges extending radially outward from the radially expandable tubular, at least one of the one or more continuous anchoring ridges having a plurality of spaced apart localized hardened sections placed circumferentially there around and extending along a top surface and side wall surfaces thereof, the radially expandable tubular configured to move from an initial state wherein the one or more continuous anchoring ridges are not in contact with a wellbore tubular to an expanded state wherein the one or more continuous anchoring ridges are in gripping engagement with the wellbore tubular.

2. The expandable liner hanger assembly of claim 1, wherein the at least one of the one or more continuous anchoring ridges has at least four localized hardened sections placed circumferentially there around.

3. The expandable liner hanger assembly of claim 2, wherein the at least four localized hardened sections are placed circumferentially equidistance there around.

4. The expandable liner hanger assembly of claim 1, wherein the at least one of the one or more continuous anchoring ridges has at least eighteen localized hardened sections placed circumferentially there around.

5. The expandable liner hanger assembly of claim 4, wherein the at least eighteen localized hardened sections are placed circumferentially equidistance there around.

6. The expandable liner hanger assembly of claim 4, wherein the at least one of the one or more continuous anchoring ridges has a plurality of ductile sections placed between the plurality of localized hardened sections.

7. The expandable liner hanger assembly of claim 6, wherein the at least eighteen localized hardened sections each extend circumferentially around the radially expandable tubular an angle (β) of 10 degrees or less.

8. The expandable liner hanger assembly of claim 7, wherein the plurality of ductile sections each extend circumferentially around the radially expandable tubular an angle (Ω) of 5 degrees or less.

9. The expandable liner hanger assembly of claim 8, wherein a ratio of the angle (β) to the angle (Ω) ranges from 4:1 to 1:1.

10. The expandable liner hanger assembly of claim 6, wherein the plurality of localized hardened sections have a hardened section minimum yield strength at least 10% greater than a ductile section minimum yield strength of the plurality of ductile sections.

11. The expandable liner hanger assembly of claim 6, wherein the plurality of localized hardened sections have a hardened section minimum yield strength at least 50% greater than a ductile section minimum yield strength of the plurality of ductile sections.

12. The expandable liner hanger assembly of claim 6, wherein the plurality of localized hardened sections have a hardened section minimum yield strength at least 100% greater than a ductile section minimum yield strength of the plurality of ductile sections.

13. The expandable liner hanger assembly of claim 6, wherein the plurality of ductile sections are radially outside of the plurality of hardened sections and the radially expandable tubular is in the initial state.

14. The expandable liner hanger assembly of claim 1, wherein the plurality of localized hardened sections are a plurality of localized hardened layers placed circumferentially there around.

15. The expandable liner hanger assembly of claim 14, wherein the plurality of hardened layers have a thickness of 0.25 μm or less.

16. The expandable liner hanger assembly of claim 14, wherein the plurality of hardened layers have a thickness ranging from 0.025 μm to 0.076 μm.

17. A well system, comprising:

a wellbore extending through one or more subterranean formations;

wellbore tubular positioned within the wellbore; and an expandable liner hanger assembly positioned within the wellbore tubular, the expandable liner hanger assembly including:

a radially expandable tubular defining an interior passageway and an exterior surface; and one or more continuous anchoring ridges extending radially outward from the radially expandable tubular, at least one of the one or more continuous anchoring ridges having a plurality of spaced apart localized hardened sections placed circumferentially there around and extending along a top surface and side wall surfaces thereof, the radially expandable tubular configured to move from an initial state wherein the one or more continuous anchoring ridges are not in contact with the wellbore tubular to an expanded state wherein the one or more continuous anchoring ridges are in gripping engagement with the wellbore tubular.

18. The well system of claim 17, wherein the at least one of the one or more continuous anchoring ridges has at least eighteen localized hardened sections placed circumferentially equidistance there around.

19. The well system of claim 18, wherein the at least one of the one or more continuous anchoring ridges has a plurality of ductile sections placed between the plurality of localized hardened sections.

20. The well system of claim 19, wherein the at least eighteen localized hardened sections each extend circumferentially around the radially expandable tubular an angle (β) of 10 degrees or less.

21. The well system of claim 20, wherein the plurality of ductile sections each extend circumferentially around the radially expandable tubular an angle (Ω) of 5 degrees or less.

22. The well system of claim 21, wherein a ratio of the angle (β) to the angle (Ω) ranges from 4:1 to 1:1.

23. The well system of claim 19, wherein the plurality of localized hardened sections have a hardened section minimum yield strength at least 10% greater than a ductile section minimum yield strength of the plurality of ductile sections.

24. The well system of claim 19, wherein the plurality of localized hardened sections have a hardened section minimum yield strength at least 50% greater than a ductile section minimum yield strength of the plurality of ductile sections.

25. The well system of claim 19, wherein the plurality of localized hardened sections have a hardened section minimum yield strength at least 100% greater than a ductile section minimum yield strength of the plurality of ductile sections.

26. The well system of claim 19, wherein the plurality of ductile sections are radially outside of the plurality of hardened sections and the radially expandable tubular is in the initial state.

27. The well system of claim 17, wherein the plurality of localized hardened sections are a plurality of localized hardened layers placed circumferentially there around.

28. The well system of claim 27, wherein the plurality of hardened layers have a thickness of 0.25 μm or less.

29. The well system of claim 27, wherein the plurality of hardened layers have a thickness ranging from 0.025 μm to 0.076 μm.

* * * * *